US005610119A

United States Patent [19]

Ueno et al.

[11] Patent Number: 5,610,119

[45] Date of Patent: Mar. 11, 1997

[54] THERMAL TRANSFER IMAGE RECEIVING SHEET

[75] Inventors: Takeshi Ueno; Katsuyuki Oshima; Mikio Asajima; Mineo Yamauchi; Kazunobu Imoto; Hidetake Takahara; Jitsuhiko Ando, all of Tokyo-to, Japan

[73] Assignee: Dai Nippon Printing Co., Ltd., Japan

[21] Appl. No.: 575,014

[22] Filed: Dec. 19, 1995

Related U.S. Application Data

[60] Continuation of Ser. No. 160,411, Dec. 1, 1993, abandoned, which is a division of Ser. No. 887,482, May 22, 1992, Pat. No. 5,318,943.

[30] Foreign Application Priority Data

| | | | |
|---|---|---|---|
| May 30, 1991 | [JP] | Japan | 3-153804 |
| May 27, 1991 | [JP] | Japan | 3-149294 |
| May 27, 1991 | [JP] | Japan | 3-149295 |
| May 28, 1991 | [JP] | Japan | 3-150910 |
| Jul. 1, 1991 | [JP] | Japan | 3-185798 |
| Jul. 24, 1991 | [JP] | Japan | 3-206208 |
| Jul. 30, 1991 | [JP] | Japan | 3-211438 |

[51] Int. Cl.[6] ..... B41M 5/035; B41M 5/38

[52] U.S. Cl. ..... 503/227; 428/195; 428/304.4; 428/913; 428/914

[58] Field of Search ..... 8/471; 428/195, 428/304.4, 913, 914; 503/227

[56] References Cited

FOREIGN PATENT DOCUMENTS 61-186471 11/1986 Japan ..... 503/227

*Primary Examiner*—B. Hamilton Hess
*Attorney, Agent, or Firm*—Ladas & Parry

[57] ABSTRACT

Disclosed is a thermal transfer image receiving sheet comprising a substrate sheet, an intermediate layer provided on at least one surface side of the substrate sheet and a dye receptor layer provided on the surface of the intermediate layer, wherein the substrate sheet is a pulp paper, the intermediate layer is formed from an organic solvent solution of a resin, and the dye receptor layer is formed from an aqueous resin liquid. By virtue of this structure, the thermal transfer image receiving sheet can be prevented from occurrence of curling caused by temperature change. Also disclosed is a thermal transfer image receiving sheet comprising a substrate sheet, an intermediate layer provided on at least one surface side of the substrate sheet and a dye receptor layer provided on the surface of the intermediate layer, wherein the intermediate layer is formed from either an acrylic resin or a resin at least a part of which is crosslinked. By virtue of this structure, the thermal transfer image receiving sheet can be excellent in smoothness, strength, cushioning properties and writing properties, and further can give an image of high density and high resolution.

8 Claims, 3 Drawing Sheets

THERMAL TRANSFER IMAGE RECEIVING SHEET

This is a continuation of application Ser. No. 08/160,411 filed on Dec. 1, 1993, now abandoned, which is a Division of U.S. Ser. No. 07/887,482 filed May 22, 1992, now U.S. Pat. No. 5,318,943.

FIELD OF THE INVENTION

The present invention relates to a thermal transfer image receiving sheet, more particularly to a thermal transfer image receiving sheet capable of forming an image of high density and high resolution.

BACKGROUND OF THE INVENTION

Various thermal transfer methods have been heretofore known. Of these, there has been proposed a method in which a sublimable dye is used as a recording agent and is supported on a substrate sheet such as a paper or a plastic film to prepare a thermal transfer sheet, and using the thermal transfer sheet, various full color images are formed on a thermal transfer image receiving sheet which is capable of being deposited with a sublimable dye, for example, a thermal image receiving sheet having a dye receptor layer on a paper or a plastic film.

In such a case, a thermal head of a printer is used as a heating means, so that a great number of color dots of three or four colors are transferred onto the thermal transfer image receiving sheet under heating for a short period of time, thereby to reproduce a full color image of an original. Such images as obtained above are very sharp because the used colorant is a dye, and are also excellent in transparency. Therefore, the images are excellent in half tone reproducibility and gradation properties, and are substantially the saxne as those formed by the conventional offset printing and gravure printing. Further, when the above image forming method is used, there can be formed images having high quality which are comparable to full color photographic images.

As the substrate sheet of the thermal transfer image receiving sheet used in the above sublimation type thermal transfer method, a plastic sheet, a laminate sheet of a plastic sheet and a paper, a synthetic paper, etc. are employed. However, in order to widely utilize the sublimation type thermal transfer method also in common offices, it is required to use ordinary papers such as a coat paper (i.e., art paper), a cast coat paper and a PPC paper as the substrate sheet of the image receiving sheet. In the case where such ordinary office papers are used as the substrate sheet and a dye receptor layer is formed thereon, there resides such a problem that when the paper is coated with an aqueous solution of a water-soluble resin or an aqueous emulsion of a water-insoluble resin to fill up the paper surface, water content is absorbed by a coat layer or a cast coat layer of the paper, resulting in waviness of the paper substrate in the drying procedure after the coating procedure. If the paper is coated with a solution of a hydrophobic resin, such problem hardly occur, but in this case other problems reside. That is, when a large amount of the solution is used in order to enhance the printed image quality, marked curling is brought about with moisture variation, because the pulp paper substrate has moisture absorption characteristics and the receptor layer is hydrophobic, etc., resulting in deterioration of printed image quality. Moreover, rubbing with a conveying roller during the printing procedure causes occurrence of paper powder.

Further, when the above-mentioned thermal transfer method is carried out, especially when an image having high gradation characteristics and shades of large difference is demanded, a large heat energy is out put from the thermal head within an area of high density, and thereby various problems occur. For example, the surface of the receptor layer suffers depressed and protruded portions, the substrate sheet of the thermal transfer image receiving sheet suffers thermal deformation in the excessive case, and curling is brought about on the thermal transfer image receiving sheet, whereby quality of the obtained image deteriorates. In the case of forming a full color image, printing procedures of 3 to 4 times are conducted on the same region of the receptor layer. Therefore, if the surface of the receptor layer is depressed and protruded, the transference of the dye in the second or the subsequent transferring stages is made ununiformly. As a result, the formation of an excellent full color image is hardly made, and deformation or curling of the thermal transfer image receiving sheet is much more strikingly brought about.

In addition, in the case of using the conventional thermal transfer image receiving sheets, there are such problems that the obtained printed materials are difficultly folded when they are intended to be folded or filed; they cannot be thinly folded even if the folding is possible; or they become bulky when filed, so that they are hardly applied to the ordinary office uses. Moreover, because of high cost and lacking of ordinary paper-like texture, they are unsuitable for ordinary office supplies.

In other conventional image receiving sheets in which the above-mentioned various substrate sheets are used and a dye receptor layer made of a thermal plastic resin such as a polyester resin, a vinyl chloride resin and a vinyl chloride/vinyl acetate copolymer resin is provided thereon, the dye receptor layer is easily peeled off due to the heat of the thermal head during the thermal transferring procedure or due to the adhesive tape.

For the formation of a sharp image, a sufficient whiteness of the dye receptor layer is necessary. However, when a large amount of a white pigment is introduced into the dye receptor layer for that purpose, deposition properties of the dye are decreased. Further, for obtaining an image of high resolution free from color dropout, decoloring, etc., the image receiving sheet is required to have sufficient cushioning properties so as to bring the dye receptor layer into good contact with the thermal head.

Such cushioning properties are generally obtained by forming an intermediate layer made of a resin having high cushioning properties between the substrate sheet and the receptor layer.

A most effective layer as the intermediate layer is a layer containing bubbles. In this case, however, when an image is formed by the thermal head, the bubbles contained in the intermediate layer are expanded again owing to the heat of the thermal head to make the surface of the receptor layer depressed and protruded or to break through the receptor layer, whereby the receptor layer becomes defective to give an adverse effect to the resulting image.

By providing the intermediate layer, the cushioning properties of the receptor layer can be improved, but the physical strength thereof is lowered. For example, if writing with a pencil or the like is intended to be made on the receptor layer before or after the image formation, a lead of the pencil scratches and writing is difficult because of low strength of the receptor layer. Otherwise, if the writing is compulsively made, the receptor layer is peeled off. In the case of using the ordinary paper such as a PPC paper as the substrate sheet of the image receiving sheet as described before, there is brought about such a problem that unevenness occur on the surface of the dye receptor layer correspondingly to the roughness of the surface of the paper substrate. For solving this problem, a transfer method in which the dye receptor layer is transferred onto the surface of the paper is known. In this method, a receptor layer-transfer film having a dye receptor layer and an adhesive layer laminated on a surface of a substrate film having high releasability is employed.

However, since the adhesive layer of the conventional receptor layer transfer films uses a heat-sensitive thermoplastic resin, the transference of the receptor layer needs application of heat, so that it is difficult to conduct high-speed transference. Further, in the case of using a coarse substrate sheet (e.g., paper) as the substrate sheet, adhesion strength thereof is insufficient in the high-speed transference. Moreover, the resulting image receiving sheet does not have satisfactory cushioning properties.

Among the thermal transfer image receiving sheets used in the above-mentioned thermal transfer methods, those having a dye receptor layer made of a thermoplastic resin on the surface of the substrate sheet require that an image of a dye is provided on the dye receptor layer. Therefore, a sensor for discriminating between a front surface and a back surface of the image receiving sheet is fitted to the thermal transfer device, and any one of the front and back surfaces of the image receiving sheet is provided with a detection mark capable of being detected by the sensor.

The detection of the front and back surfaces is made by a conventional optical means, so that on the image receiving sheet is formed a black or black-like detection mark having a reflectance largely different from that of the image receiving sheet. Accordingly, such detection mark exists on the image-formed surface, and thereby an appearance of the obtained image becomes bad.

Of course, the detection mark may be provided on the back surface of the image receiving sheet, but in this case, the detection mark can be seen through from the front surface, resulting in bad appearance of the obtained image. Moreover, in the case of forming the dye receptor layer on each surface side of the image receiving sheet, the same problem as described above still remains.

Formation of various information such as a photograph of face in the above thermal transfer methods is carried out by deposition of the dye within the card substrate, so that thus formed various information shows high smoothness, alter-preventing proper-ties and forgery-preventing properties. However, since the protective layer can be removed with a solvent, an acid, a base, etc., alteration or forging of photographs and other information is not completely prevented.

OBJECT OF THE INVENTION

It is an object of the present invention is to solve the above-mentioned various problems accompanied by the prior arts, and to provide a thermal transfer image receiving sheet free from waving and curling even when the receptor layer is thickened and not producing any paper powder.

It is another object of the invention to provide a thermal transfer image receiving sheet capable of forming a dye image of high quality even in the case where high gradation and large difference in the density are required for the image.

It is a further object of the invention to provide a thermal transfer image receiving sheet available at a low cost, which can be easily folded and filed and has ordinary paper-like texture.

It is a still further object of the invention to provide a thermal transfer image receiving sheet excellent in smoothness, strength, cushioning properties and writing properties of the dye receptor layer and capable of forming an image of high density and high resolution.

It is a still further object of the invention to provide a thermal transfer image receiving sheet excellent in adhesion properties, whiteness, cushioning properties, etc.

It is a still further object of the invention to provide a thermal transfer image receiving sheet whose front and back surface sides can be easily discriminated in a printer and which can give an image of good appearance.

It is a still further object of the invention to provide a thermal transfer image receiving sheet capable of forming an image much more improved in alter-preventing properties and forgery-preventing properties.

A first embodiment of the invention is a thermal transfer image receiving sheet comprising a substrate sheet, an intermediate layer provided on at least one side surface of the substrate sheet and a dye receptor layer provided on the surface of the intermediate layer, wherein the substrate sheet is a pulp paper, the intermediate layer is formed from an organic solvent solution of a resin, and the dye receptor layer is formed from an aqueous resin liquid of a hydrophobic resin.

By the first embodiment, a thermal transfer image receiving sheet reduced in occurrence of curling caused by moisture variation can be obtained.

A second embodiment of the invention is a thermal transfer image receiving sheet comprising a substrate sheet and a dye receptor layer provided on at least one side surface of the substrate sheet, wherein at least one of the substrate sheet and the dye receptor layer contains a heat-absorbing material which absorbs heat at a temperature in the range of 80° to 200° C.

By the second embodiment, the receptor layer is prevented from occurrence of depressed and protruded portions and the image receiving sheet can be prevented from deformation and curling, whereby a full color image of high quality can be formed.

A third embodiment of the invention is a thermal transfer image receiving sheet comprising a substrate sheet and a dye receptor layer provided on at least one side surface of the substrate sheet, wherein the substrate sheet is a paper substrate sheet having a basis weight in the range of 60 to 120 g/m$^2$.

By the third embodiment, a thermal transfer image receiving sheet which can be easily folded and filed and is excellent in the ordinary paper-like texture can be obtained at a low cost.

A fourth embodiment of the invention is a thermal transfer image receiving sheet comprising a substrate sheet and a dye receptor layer provided on at least one side surface of the substrate sheet, wherein the substrate sheet is either a pulp paper impregnated with an aqueous resin or a pulp paper coated with an aqueous resin.

By the fourth embodiment, the substrate sheet of the thermal transfer image receiving sheet can be enhanced in the water retention characteristics to restrain releasing and absorption of water content from the substrate sheet, and the hydrophobic dye receptor layer can be made thin, so that curling caused by the environmental moisture variation and occurrence of paper powder can be restrained.

A fifth embodiment of the invention is a thermal transfer image receiving sheet comprising a substrate sheet, an intermediate layer provided on at least one side surface of the substrate sheet and a dye receptor layer provided on the surface of the intermediate layer, wherein the intermediate layer is formed from either an acrylic resin or a resin at least a part of which is crosslinked. This fifth embodiment also includes a thermal transfer image receiving sheet comprising a substrate sheet, a bubble-containing layer provided on at least one side surface of the substrate sheet, an intermediate layer provided on the surface of the bubble-containing layer and a dye receptor layer provided on the surface of the intermediate layer.

By the fifth embodiment, a thermal transfer image receiving sheet which is excellent in smoothness, strength, cushioning properties and writing properties of the dye receptor layer and capable of forming an image of high density and high resolution can be obtained.

A sixth embodiment of the invention is a thermal transfer image receiving sheet comprising a substrate sheet, an intermediate layer provided on at least one side surface of the substrate sheet and a dye receptor layer provided on the surface of the intermediate layer, wherein the intermediate layer is formed from a chlorinated polypropylene resin.

By the sixth embodiment, a thermal transfer image receiving sheet excellent in adhesion properties and cushioning properties can be obtained.

A seventh embodiment of the invention is a thermal transfer image receiving sheet comprising a substrate sheet, an intermediate layer provided on at least one side surface of the substrate sheet and a dye receptor layer provided on the surface of the intermediate layer, wherein the intermediate layer is formed from such a resin as to have a glass transition temperature in the range of −80° to 20° C.

By the seventh embodiment, a thermal transfer image receiving sheet excellent in cushioning properties can be obtained.

A eighth embodiment of the invention is a thermal transfer image receiving sheet comprising a substrate sheet and a dye receptor layer provided on at least one side surface of the substrate sheet, wherein at least one side surface of the image receiving sheet has either a detection mark undistinguishable with the naked eye or an inconspicuous detection mark.

By the eighth embodiment, a thermal transfer image receiving sheet whose front and back surfaces can be easily discriminated in a printer and which can form an image of good appearance can be obtained.

A ninth embodiment of the invention is a thermal transfer image receiving sheet comprising a substrate sheet and a transparent dye receptor layer provided on at least one side surface of the substrate sheet, wherein an optional pattern is provided between the substrate sheet and the transparent dye receptor layer.

By the ninth embodiment, the pattern forms a background of the image, and accordingly, if a false photograph of face is attached thereto, the attached false photograph hides the pattern, whereby altering or forging becomes apparent. Otherwise, if the image is intended to be removed with special chemicals, the pattern behind the image is simultaneously eliminated, and an accurate recovery of the pattern is difficult.

DESCRIPTION OF THE PREFERRED EMBODIMENT

The present invention is described below in more detail with reference to preferred embodiments thereof.

Figure 1:
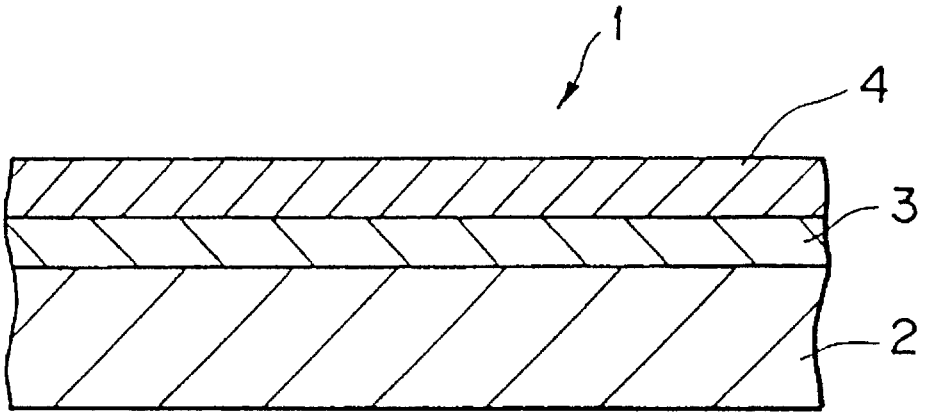
FIG. 1 is a schematic sectional view showing one example of the thermal transfer image receiving sheet according to the invention.

FIG. 1 is schematic sectional view showing the first embodiment of the thermal transfer image receiving sheet according to the invention. In FIG. 1, the thermal transfer image receiving sheet 1 comprises a substrate sheet 2, an intermediate layer 3 provided on the substrate sheet 2 and a dye receptor layer 4 provided on the intermediate layer 3.

This embodiment is characterized in that the substrate sheet 2 is a pulp paper, the intermediate layer 3 is formed from an organic solvent solution of a resin, and the dye receptor layer 4 is formed form an aqueous resin liquid of a hydrophobic resin.

The pulp paper substrate preferably used in this embodiment includes a coat paper (art paper) and a cast coat paper, and the thickness of the pulp paper substrate is preferably in the range of 50 to 250 g/m$^2$ in terms of a basis weight. Too small thickness is unfavorable from the viewpoints of strength and conveying properties in a printer. On the other hand, too large thickness is unfavorable from the viewpoints of weight and cost.

Examples of the resin for the intermediate layer 3 provided as a water barrier layer on the above-mentioned coat paper or cast coat paper include halogenated vinyl resins such as polyvinyl chloride and polyvinylidene chloride; vinyl resins such as polyvinyl acetate, vinyl chloride/vinyl acetate copolymer, ethylene/vinyl acetate copolymer and polyacrylic ester; polyester resins such as polyethylene terephthalate and polybutylene terephthalate; polystyrene resins; polyamide resins; copolymer resins of olefin (e.g., ethylene and propylene) and other vinyl monomer; ionomer; cellulose resins such as cellulose diacetate; and polycarbonate, etc.. Of these, particularly preferred are vinyl resins.

The resins mentioned as above are dissolved in an appropriate organic solvent such as acetone, ethyl acetate, methyl ethyl ketone, toluene, xylene and cyclohexanone to prepare a coating solution or an ink. If desired, additives to improve a whiteness or to enhance cushioning properties, such as white pigment, foaming agent and bubbles, may be added. Thus prepared solution or ink is applied onto the substrate by conventional coating means such as a gravure printing, a screen printing, a reverse roll coating using a gravure plate, and then dried to form the intermediate layer. The thickness of the intermediate layer 3 formed as above is preferably in the range of about 0.5 to 5 μm.

The dye receptor layer 4 formed on the surface of the above intermediate layer 3 serves to receive a sublimable dye transferred from a thermal transfer sheet and to maintain the formed image. Examples of binder resins for forming the dye receptor layer include polyolefin resins such as polypropylene; halogenated vinyl resins such as polyvinyl chloride and polyvinylidene chloride; vinyl resins such as polyvinyl acetate, vinyl chloride/vinyl acetate copolymer, ethylene/vinyl acetate copolymer and polyacrylic ester; polyester resins such as polyethylene terephthalate and polybutylene terephthalate; polystyrene resins; polyamide resins; copolymer resins of olefin (e.g., ethylene and propylene) and other vinyl monomer; ionomer; cellulose resins such as cellulose diacetate; and polycarbonate,etc. Of these, particularly preferred are vinyl resins and polyester resins. Using these resins, an aqueous resin liquid such as an aqueous emulsion is prepared, and if desired, to the aqueous resin liquid may be added additives such as a surface active agent, a releasing agent, an antioxidant and an ultraviolet absorbent. Thus prepared aqueous resin liquid is applied onto the intermediate layer by conventional coating means such as a gravure printing, a screen printing, a reverse roll coating using a gravure plate, and then dried to form the dye receptor layer. In the case where the aqueous emulsion containing a surface active agent is used, the dye receptor layer 4 can have moisture absorption characteristics as the pulp paper substrate because the surface active agent is hydrophilic.

The dye receptor layer 4 preferably contains a releasing agent to give a high releasability from a thermal transfer sheet. Examples of preferred releasing agents include silicone oils, phosphoric ester type surface active agents and fluorine type surface active agents. Of these, particularly preferred are silicone oils. As the silicone oils, desirable are epoxy modified, alkyl modified, amino modified, carboxyl modified, alcohol modified, fluorine modified, alkyl aralkyl polyether modified, epoxypolyether modified, and polyether modified silicone oils. One or more kinds of the releasing agents can be employed. The amount of the releasing agent used herein is preferably in the range of 1 to 20 parts by weight based on 100 parts by weight of the binder resin. If the amount thereof is not within the above range, a problem of fusion of the dye receptor layer 4 to the thermal transfer sheet or a problem of reduction of printing sensitivity may occur. The thickness of the dye receptor layer 4 formed as above is optional, but generally in the range of 1 to 50 μm. Further, the thickness of the dye receptor layer 4 is preferably in the range of 0.1 to 5% based on the thickness of the thermal transfer image receiving sheet.

Figure 2:
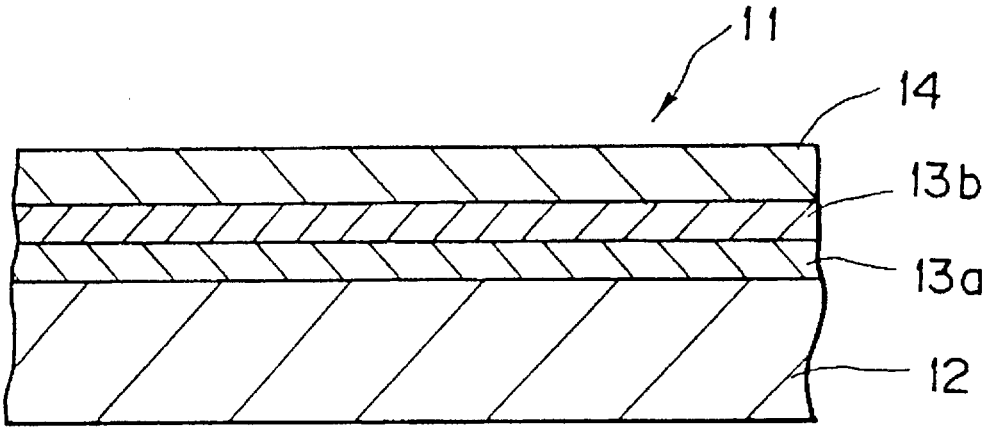
FIG. 2 is a schematic sectional view showing other example of the thermal transfer image receiving sheet according to the invention.

FIG. 2 is a schematic sectional view showing other example of the first embodiment of the thermal transfer image receiving sheet according to the invention. In the thermal transfer image receiving sheet 11 of FIG. 2, an intermediate layer 13*a* formed from an organic solvent solution of a resin likewise the abovementioned intermediate layer 3 is provided as a first intermediate layer, and on the surface of the first intermediate layer 13*a* is further provided a second intermediate layer 13*b* formed from an aqueous resin. In the case of providing these intermediate layers, the dye receptor layer 14 to be formed thereon can be made of an organic solvent solution of an appropriate resin described above. A substrate sheet 12 is the same as the abovementioned substrate sheet 2.

The second intermediate layer 13*b* may be formed from an aqueous resin liquid of a hydrophobic resin such as an aqueous emulsion thereof likewise the formation of the abovementioned dye receptor layer, and there can be employed, for example, aqueous solutions of synthetic resins such as polyvinyl alcohol, polyacrylic acid soda, polyethylene glycol, watersoluble or hydrophilic polyester resin and polyurethane resin; and aqueous solutions of natural watersoluble resins such as starch, casein and carboxymethyl cellulose. Since this intermediate layer is composed of an aqueous resin liquid, occurrence of environmental curling is reduced even if the thickness thereof is made large. Therefore, the whole receptor layer (including the intermediate layer) can be thickened to improve printed image quality and the thickness is preferably in the range of 1 to 40 μm. Further, the thickness of the dye receptor layer 14 is preferably in the range of 0.1 to 5% based on the thickness of the thermal transfer image receiving sheet.

The receptor layer 14 can be formed on the surface of the second intermediate layer 13*b* in the same manner as described above, or applying an organic solvent solution of a resin for forming a dye receptor layer or an aqueous resin therefor. By virtue of providing the second intermediate layer 13*b*, the dye receptor layer (including the intermediate layer) can be thickened with preventing the occurrence of curling. As a result, there can be obtained an image receiving sheet free from pinholes and excellent in cushioning properties and printed image quality.

In this embodiment, the dye receptor layer 4, 14 can be formed by a transfer method. In the transfer method, for example, the abovementioned dye receptor layer is formed on a surface of a film having high releasability such as a polyester film, then an appropriate bonding agent layer or an appropriate adhesive layer is formed on the surface of the dye receptor layer, thereafter the bonding agent layer or adhesive layer is laminated with the abovementioned intermediate layer facing each other by means of a laminator of the like, and the above film such as a polyester film is released. Otherwise, the intermediate layer may be provided on the surface of a dye receptor layer of a dye receptor layer transfer sheet.

On the opposite surface of the substrate is preferably formed a slip layer having a thickness of for example 1 to 5 $g/m^2$ made of such a resin as having high slipperiness (e.g., acrylic resin or acrylic silicone resin) or a mixture of said resin and adequate slippery particles, to improve conveying properties of the image receiving sheet in a printer.

A thermal transfer sheet used in conducting the thermal transfer method using the thermal transfer image receiving sheet of the above embodiment has a dye layer containing a sublimable dye on a paper or a polyester film, and any conventional thermal transfer sheets can be per se employed.

As means for applying heat energy in the thermal transfer method, any conventional means can be utilized. For example, a heat energy of about 5 to 100 $mJ/mm^2$ is given by means of a recording device such as a thermal printer (e.g., Video Printer VY100 produced by Hitachi, Ltd.) while controlling the recording time, so as to accomplish the initially aimed objects.

The above embodiment is described below in more concrete with reference to examples. In the examples, "part(s)" and "%" mean "part(s) by weight" and "% by weight", respectively, unless otherwise noted specifically.

EXAMPLE A

First, coating liquids for receptor layers and coating liquids for intermediate layers each having the following composition were prepared.

| Composition of coating liquid 1 for receptor layer | |
|---|---|
| Vinyl chloride/vinyl acetate copolymer resin (VYHD, available from Union Carbide) | 100 parts |
| Epoxy modified silicone (KF393, available from Shinetsu Kagaku Kogyo K.K.) | 3 parts |
| Amino modified silicone (KS 343, available from Shinetsu Kagaku Kogyo K.K.) | 3 parts |
| Methyl ethyl ketone | 500 parts |
| **Composition of coating liquid 2 for receptor layer** | |
| Ethylene/vinyl acetate copolymer resin (AD37P295, available from Toyo Morton K.K., aqueous emulsion) | 100 parts |
| Polyether modified silicone resin (SH3756, available from Toray Daw Corning Silicone K.K., aqueous emulsion) | 10 parts |
| Pure water | 300 parts |
| **Composition of coating liquid 1 for intermediate layer** | |
| Vinyl chloride/vinyl acetate copolymer resin (VYHD, available from Union Carbide) | 100 parts |
| Methyl ethyl ketone | 500 parts |
| **Composition of coating liquid 2 for intermediate layer** | |
| Ethylene/vinyl acetate copolymer resin (AD37P295, available from Toyo Morton K.K., aqueous emulsion) | 100 parts |
| Pure water | 300 parts |

(A-1)

Then, onto a cast surface of a cast coat paper (New Coat Gold, available from Kanzaki Seishi K.K., basis weight: 84.9 g/m$^2$) was applied the coating liquid 1 for an intermediate layer in an amount of 1 g/m$^2$ (solid content), followed by drying, and thereonto was applied the coating liquid 2 for a receptor layer in an amount of 9 g/m$^2$ (solid content), followed by drying, to form a dye receptor layer. Thus, a thermal transfer image receiving sheet (A-1) of the invention was obtained.

(A-2)

Onto a surface of a coat paper (Daiya Coat, available from Jujo Seishi K.K., basis weight: 73.3 g/m$^2$) was applied the coating liquid 1 for an intermediate layer in an amount of 1 g/m$^2$ (solid content), followed by drying, then thereonto was applied the coating liquid 2 for an intermediate layer in an amount of 3 g/m$^2$ (solid content), followed by drying, and thereonto was further applied the coating liquid 1 for a receptor layer in an amount of 6 g/m$^2$ (solid content), followed by drying, to form a dye receptor layer. Thus, a thermal transfer image receiving sheet (A-2) of the invention was obtained.

(A-3)

The procedure for obtaining the thermal transfer image receiving sheet (A-1) was repeated except for using an art paper (Chrome Dalart, available from Kanzaki Seishi K.K., basis weight: 127.9 g/m$^2$) instead of the cast coat paper, to obtain a thermal transfer image receiving sheet (A-3) of the invention.

(a-1)

The procedure for obtaining the thermal transfer image receiving sheet (A-1) was repeated except that the coating liquid 2 for a receptor layer was applied onto a cast surface of the cast coat paper (New Coat Gold, available from Kanzaki Seishi K.K., basis weight: 84.9 g/m$^2$) in an amount of 2 g/m$^2$ (solid content) and dried to form a dye receptor layer, whereby a thermal transfer image receiving sheet (a-1) for comparison was obtained.

(a-2)

The procedure for obtaining the thermal transfer image receiving sheet (A-1) was repeated except that the coating liquid 1 for a receptor layer was applied onto the cast surface of a cast coat paper (New Coat Gold, available from Kanzaki Seishi K.K., basis weight: 84.9 g/m$^2$) in an amount of 10 g/m$^2$ (solid content) and dried to form a dye receptor layer, whereby a thermal transfer image receiving sheet (a-2) for comparison was obtained.

Each of the aboveobtained thermal transfer image receiving sheets (A-1) to (A-3), (a-1) and (a-2) was allowed to stand for 48 hours under the conditions of 40° C. and 90% RH to examine occurrence of curling. The results are set forth in Table 1.

Separately, an ink having the following composition for a dye layer was prepared. The ink was applied onto a polyethylene terephthalate film (thickness: 6 μm) having been subjected to a heat resistance treatment on the back surface in an amount of 1.0 g/m$^2$ (dry basis) by means of a wire bar, and dried. Further, On the back surface were dropped several drops of a silicone oil (X-414003A, available from Shinetsu Kagaku Kogyo K.K.) by means of a dropping pipette, and the silicone oil was extended all over the surface to perform a back surface treatment. Thus, a thermal transfer sheet was obtained.

| Composition of ink for dye layer | |
|---|---|
| Dye to be dispersed (Kayaset Blue 714, available from Nippon Kayaku Co., Ltd.) | 4.0 part |
| Ethylhydroxy cellulose (available from Hercures) | 5.0 part |
| Methyl ethyl ketone/toluene (ratio by weight: 1/1) | 80.0 part |
| Dioxane | 10.0 part |

The thermal transfer sheet was superposed on the thermal transfer image receiving sheet prior to subjecting it to the aforementioned curling test, and they were subjected to a printing procedure using a thermal head under the conditions output of 1 W/dot, a puls width of 0.3 to 0.45 msec. anl a. dot density of 3 dot/mm to form a cyan forth in Table 1.

TABLE 1

| Thermal Transfer Image Receiving Sheet | Appearance of Sheet | Image Quality | Image Density | Environtal Curling |
|---|---|---|---|---|
| A-1 | good | sharp | high | good |
| A-2 | good | sharp | high | good |
| A-3 | good | sharp | high | good |
| a-1 (Comparison Example) | wavy | faint | low | good |
| a-2 (Comparison Example) | good | sharp | high | marked curling |

Figure 3:
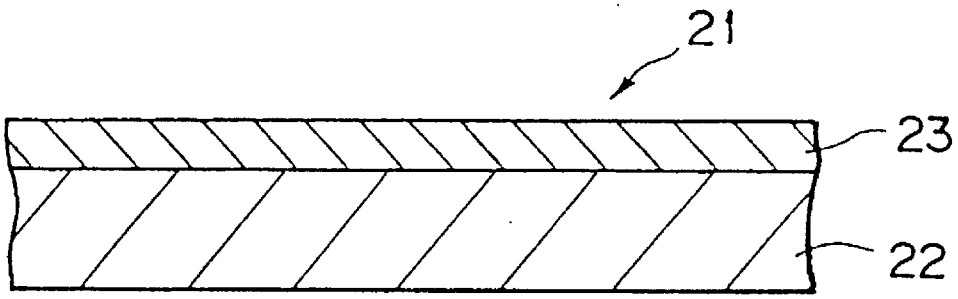
FIG. 3 is a schematic sectional view showing other example of the thermal transfer image receiving sheet according to the invention.

FIG. 3 is a schematic sectional view showing the second embodiment of the thermal transfer image receiving sheet according to the invention. In FIG. 3, the thermal transfer image receiving sheet 21 comprises a substrate sheet 22 and a dye receptor layer 23 provided on at least one surface side (only one surface side in the figure) of the substrate.

Examples of the substrate sheets employable in this embodiment include synthetic paper (polyolefin type, polystyrene type, etc.), fine paper, art paper, coat paper, cast coat paper, wall paper, backed paper, synthetic resin impregnated paper, emulsion impregnated paper, synthetic rubber impregnated paper, synthetic resin containing paper, plate paper, cellulose fiber paper, and films or sheets of various plastics such as polyolefin, polyvinyl chloride, polyethylene terephthalate, polystyrene, polymethacrylate and polycarbonate. Also employable are white opaque films obtained by adding white pigment or filler to these synthetic resins and expanded sheets.

Further, laminates obtained by optional combination of the above substrate sheets are employable. Representative laminates include a laminate of a cellulose fiber paper and a synthetic paper, a laminate of a cellulose fiber paper and a plastic film or a plastic sheet.

The thickness of the substrate sheet is optional, but generally in the range of 10 to 300 μm.

The substrate sheet as mentioned above is preferably subjected to a primer treatment or a corona discharge treatment if the substrate sheet has a poor adhesion to the dye receptor layer to be formed thereon.

The dye receptor layer formed on the surface of the above substrate sheet serves to receive a sublimable dye transferred from a thermal transfer sheet and to maintain the formed image.

As the resin for forming the dye receptor layer, there can be used, for example, binder resins used for the dye receptor layer 4 of the aforementioned first embodiment.

In this embodiment, the substrate sheet 22 and/or the dye receptor layer 23 contains a heat absorbing material which absorbs heat at a temperature of 80° to 200° C. The heat absorbing material which absorbs heat at a temperature of 80° to 200° C. is generally a fine powder of crystal, and examples thereof include fine powders of crystals such as AgI (melting point: 147° C.), $Cu_2S$ (melting point: 103° C.), $NH_4BF_6$ (melting point: 199.6° C.), $W(CO)_6$ (melting point: 127° C.) and hydroquinone (melting point: 171.5° C.).

If these heat absorbing materials reduce the properties of the substrate or the dye receptor layer, they may be used in the form of microcapsules by encapsulating them in a thin film of an inert polymer or the like.

In the case where the heat absorption is brought about at a temperature of lower than 80° C., a heat supplied by the thermal head is also absorbed, so that such case is unfavorable from the viewpoint of heat efficiency of the thermal head. On the other hand, in the case where the heat absorption is brought about at a temperature of higher than 200° C., the receptor layer itself is hardly heated to 200° C. or higher, so that such case is meaningless.

The above heat absorbing material is preferably contained in the dye receptor layer, and the amount thereof used herein is preferably in the range of 5 to 80 parts, more preferably 5 to 30 parts by weight per 100 parts by weight of the resin for forming the dye receptor layer. When the amount thereof is too small, the effect of heat absorption is insufficient. On the other hand, when the amount thereof is too large, the dye receptor layer is reduced in the dye receiving properties.

In the formation of the dye receptor layer, various additives and fillers such as titanium oxide, zinc oxide, kaolin clay, calcium carbonate and silica powder may be added to improve a whiteness of the dye receptor layer, and thereby to enhance the sharpness of the transferred image.

The thickness of the dye receptor layer formed as above is optional, but generally is in the range of 1 to 50 μm. The dye receptor layer is preferably formed by continuous coating, but may be formed by discontinuous coating using a resin emulsion or a resin dispersion.

The thermal transfer image receiving sheet of the invention can be sufficiently employed basically even when it has the above structure, but the dye receptor layer in the invention may contain a releasing agent to improve the releasability from a thermal transfer sheet.

The image receiving sheet of the invention may be provided with an intermediate layer (cushioning layer) formed from a thermoplastic resin between the substrate sheet 22 and the dye receptor layer 23, if desired. By the virtue of providing such intermediate layer, an image almost free from noise in the printing procedure and corresponding to the image information can be transferred and recorded with high reproducibility. In this embodiment, the intermediate layer may contain the abovementioned heat absorbing material which absorbs heat at a temperature of 80° to 200° C. In this case, abovementioned deterioration of the dye receptor layer in the dye receiving properties can be prevented.

The back surface of the image receiving sheet may be provided with a slip layer by way of a primer layer, if desired. As materials of the slip layer, there can be mentioned methacrylate resins such as methyl methacrylate, acrylate resins, and vinyl resins such as vinyl chloride/vinyl acetate copolymer. The intermediate layer, primer layer and slip layer mentioned as above may contain an antistatic agent, and further a layer of an antistatic agent may be provided on the back surface of the obtained image receiving sheet.

The above embodiment is described below in more concrete with reference to examples. In the examples, "part(s)" and "%" mean "part(s) by weight" and "% by weight", respectively, unless otherwise noted specifically.

EXAMPLE B (B-1)

A polyethylene terephthalate film (T-100, available from Toray Industries, Inc., thickness: 75 μm) was used as a substrate sheet. Onto one surface of the film was applied a coating liquid for a receptor layer having the following composition in an amount of 5.0 g/m$^2$ (dry basis) using a bar coater, and onto the back surface thereof was applied a coating liquid for a primer layer having the following composition in an amount of 1.0 g/m$^2$ (dry basis) using a bar coater. The coated layers were immediately simply dried by means of a dryer, and then dried in an oven at 120° C. for 5 minutes to form a dye receptor layer and a primer layer.

| Composition of coating liquid for receptor layer | |
|---|---|
| Polyester resin (Bylon 600, available from Toyobo K.K.) | 4.0 parts |
| Vinyl chloride/vinyl acetate copolymer (#1000A, available from Denki Kagaku Kogyo K.K.) | 6.0 parts |
| Amino modified silicone (X-22-3050C, available from Shinetsu Kagaku Kogyo K.K.) | 0.2 part |
| Epoxy modified silicone (X-22-3000E, available from Shinetsu Kagaku Kogyo K.K.) | 0.2 part |
| Heat-absorbing material (Hydroquinone) | 1.0 part |
| Methyl ethyl ketone/toluene (1:1) | 89.5 parts |
| **Composition of coating liquid for primer layer** | |
| Polyester polyol (Adcoat, available from Toyo Morton K.K.) | 15.3 parts |
| Methyl ethyl ketone/toluene (2:1) | 85.0 parts |

Next, onto the primer layer side surface was applied a coating liquid for a back surface slip layer having the following composition in an amount of 1.0 g/m$^2$ (solid content) and dried in the same manner as described above, to obtain a thermal transfer image receiving sheet (B1) of the invention.

| Composition of coating liquid for back surface slip layer | |
|---|---|
| Acrylic resin (BR-85, available from Mitsubishi Rayon K.K.) | 15.0 parts |
| Filler (Orgasol, available from Nippon Rirusan K.K.) | 0.1 part |
| Antistatic agent (TB-128, available from Matsumoto Yushi Seiyaku K.K.) | 0.1 part |
| Methyl ethyl ketone/toluene (2:1) | 89.8 parts |

(B-2) to (B-10)

The procedure for obtaining the thermal transfer image receiving sheet (B-1) was repeated except for varying the heat absorbing material to the following heat absorbing materials, to obtain thermal transfer image receiving sheets (B-2) to (B-10) of the invention.

| | | |
|---|---|---|
| (B-2): | AgI | 5 parts |
| (B-3): | $Cu_2S$ | 10 parts |
| (B-4): | $W(CO)_6$ | 5 parts |
| (B-5): | $NH_4BF_6$ | 20 parts |
| (B-6): | hydroquinone microcapsules | 1 part |
| (B-7): | AgI microcapsules | 5 parts |
| (B-8): | $Cu_2S$ microcapsules | 10 parts |
| (B-9): | $W(CO)_6$ microcapsules | 5 parts |
| (B-10): | $NH_4BF_6$ microcapsules | 20 parts |
| (B-11) | | |

Onto a surface of a synthetic paper (trade name: Yupo, available from Oji Yuka K.K.) having a thickness of 200 μm was applied a coating liquid for an intermediate layer having the following composition in an amount of 3.0 g/m$^2$ (solid content) using a bar coater, then dried by means of a dryer, and further dried in an oven at 100° C. for 5 minutes to form an intermediate layer. Onto the intermediate layer was applied a coating liquid for a receptor layer having the following composition in an amount of 5.0 g/m$^2$ (solid content) and dried in an oven at 100° C. for 5 minutes, to obtain a thermal transfer image receiving sheet (B-11) of the invention.

| Composition of coating liquid for intermediate layer | |
|---|---|
| Polyurethane resin (Takerack E, 360, available from Takeda Yakuhin K.K.) | 100 parts |
| Heat-absorbing material (Hydroquinone) | 5 parts |
| Toluene | 100 parts |
| Isopropyl alcohol | 50 parts |
| **Composition of coating liquid for receptor layer** | |
| Polyester resin (Bylon 200, available from Toyobo K.K.) | 100 parts |
| Amino modified silicone (x-22-343, available from Shinetsu Kagaku Kogyo K.K.) | 10 parts |
| Epoxy modified silicone (KF-393, available from Shinetsu Kagaku Kogyo K.K.) | 10 parts |
| Methyl ethyl ketone/Toluene (1/1 by weight) | 200 parts |

(B-12)

The procedure for obtaining the thermal transfer image receiving sheet (B-11) was repeated except for using the following coating liquid for an intermediate layer, to obtain a thermal transfer image receiving sheet (B-12) of the invention.

| Composition of coating liquid for intermediate layer | |
|---|---|
| Chlorinated polypropylene (Supercron 803 MW, available from Sanyo Kokusaku Pulp K.K.) | 100 parts |
| Titanium Oxide (CR-50, available from Ishihara Sangyo K.K.) | 50 parts |
| Heat-absorbing material (Hydroquinone) | 5 parts |
| Toluene | 200 parts |
| (b-1) | |

As a comparison example, the procedure for obtaining the thermal transfer image receiving sheet (B-1) was repeated except for not using the heat absorbing material, to obtain a thermal transfer image receiving sheet (b-1) for comparison.

Thermal transfer test

Using the above thermal transfer image receiving sheets (B-1) to (B-12) and (b-1) and thermal transfer sheets of three colors, full color images of high density were formed in order of yellow, magenta and cyan using a printer (S-340, produced by Mitsubishi Denki K.K.) under the conditions 5° C. and 20% RH, and the surface condition and the quality of the formed images were evaluated. The results are set forth in Table 2.

TABLE 2

| Thermal Transfer Image Receiving Sheet | Surface Condition | Image Quality | Curling after Printing |
|---|---|---|---|
| B-1 | smooth, moderately glossy | good in reproducibiliy, resolution and coloring | not observed |
| B-2 | smooth, moderately glossy | good in reproducibiliy, resolution and coloring | not observed |
| B-3 | smooth, moderately glossy | good in reproducibiliy, resolution and coloring | not observed |
| B-4 | smooth, moderately glossy | good in reproducibiliy, resolution and coloring | not observed |
| B-5 | smooth, moderately glossy | good in reproducibiliy, resolution and coloring | not observed |
| B-6 | smooth, moderately glossy | good in reproducibiliy, resolution and coloring | not observed |
| B-7 | smooth, moderately glossy | good in reproducibiliy, resolution and coloring | not observed |
| B-8 | smooth, moderately glossy | good in reproducibiliy, resolution and coloring | not observed |
| B-9 | smooth, moderately glossy | good in reproducibiliy, resolution and coloring | not observed |
| B-10 | smooth, moderately glossy | good in reproducibiliy, resolution and coloring | not observed |
| B-11 | smooth, moderately glossy | good in reproducibiliy, resolution and coloring | not observed |
| B-12 | smooth, moderately glossy | good in reproducibiliy, resolution and coloring | not observed |
| b-1 (Comparison Example) | a large number of finely depressed and protruded portions, not glossy | bad in reproducibility, resolution and coloring | observed |

The third embodiment of the thermal transfer image receiving sheet according to the invention is a thermal transfer image receiving sheet comprising a paper substrate sheet and a dye receptor layer provided thereon, if desired, by way of an intermediate layer, and the paper substrate sheet has a basis weight ranging from 60 to 120 g/m$^2$.

Suitable paper substrate sheets are various papers such as PPC paper, thermal transfer paper, art paper, coat paper, cast coat paper and Kent paper. These paper substrate sheets are required to have a basis weight of 60 to 120 g/m$^2$. When the basis weight is less than 60 g/m$^2$, the substrate sheet is limp and insufficient in the opaqueness, whereby the obtained image is not improved in the quality. When the basis weight is more than 120 g/m$^2$, the resulting sheet lacks folding properties when folded and filed, and the sheet becomes bulky. The whiteness and the opaqueness of the paper substrate sheet both preferably are not less than 70%.

The dye receptor layer provided on the abovementioned paper substrate sheet can be formed in the same manner as that for the dye receptor layer of the aforementioned first embodiment, so that detailed description thereof is omitted herein.

An intermediate layer may be provided between the paper substrate sheet and the dye receptor layer to improve whiteness, cushioning properties, opacifying properties, etc.

The substrate sheet or the thermal transfer image receiving sheet obtained as above is preferably subjected to an antistatic treatment or an anticurl treatment. For the antistatic treatment, various surface active agents and antistatic agents such as cationic, nonionic and anionic surface active agents and antistatic agents can be employed. The anticurl treatment is conducted preferably by coating or impregnating a watersoluble resin such as starch, casein, polyvinyl alcohol, polyacrylate or polyethylene glycol in the substrate sheet.

The above embodiment is described below in more concrete with reference to examples. In the examples, "part(s)" and "%" mean "part(s) by weight" and "% by weight", respectively, unless otherwise noted specifically.

EXAMPLE C

Onto a surface of a matted polyester film (X-42, available from Toray Industries, Inc.) was applied a coating liquid for a receptor layer having the following composition in an amount of 2.5 g/m$^2$ (dry basis) using a bar coater. The coated layer was provisionally dried by means of a dryer, and then dried in an oven at 100° C. for 30 minutes to form a dye receptor layer. Further, onto the dye receptor layer was applied an acrylic adhesive (E1000, available form Soken Kagaku K.K.) in an amount of 5 g/m$^2$ and dried to form an adhesive layer. Thus, a receptor layer transfer film was obtained.

| Composition of coating liquid for receptor layer | |
|---|---|
| Vinyl chloride/vinyl acetate copolymer (1000GKT, available from Denki Kagaku Kogyo K.K.) | 100 parts |
| Amino modified silicone (X-22-343, available from Shinetsu Kagaku Kogyo K.K.) | 3 parts |
| Epoxy modified silicone (F-393, available from Shinetsu Kagaku Kogyo K.K.) | 3 parts |
| Methyl ethyl ketone/toluene (1/1 by weight) | 500 parts |

(C-1) to (C-4), (c-1), (c-2)

The above receptor layer transfer film was laminated with each of the substrate sheets set forth in Table 3 by means of a roller, and the polyester film was released, to obtain thermal transfer image receiving sheets (C-1) to (C-4) the invention and thermal transfer image receiving sheets (c-1) and (c-2) for comparison.

The obtained thermal transfer image receiving sheets were evaluated on whiteness (%), opaqueness (%), filing properties and texture properties. The results are set forth in Table 3.

TABLE 3

| Thermal Transfer Image Receiving Sheet | Kind of Paper | Basis Weight (g/m$^2$) | Whiteness (%) | Opaqueness (%) | Filing properties | Texture |
|---|---|---|---|---|---|---|
| c-1 (Comparison Example) | A | 56 | 75.2 | 65 (insufficient) | good | good |
| C-1 | B | 64 | 85.0 | 85 | good | good |
| C-2 | C | 66 | 81.0 | 81 | good | good |
| C-3 | D | 80 | 82.4 | 90 | good | good |
| C-4 | E | 105 | 85.2 | 92 | good | good |
| c-2 (Comparison Example) | F | 127 | 86.7 | 90 | bad | good |

A: cast coat paper (test sample)
B: thermal transfer paper (TTR-PW, available from Mitsubishi Seishi K.K.)
C: PPC paper (available from JuJo Seishi K.K.)
D: cast coat paper (NK Crystal Coat, available from Nippon Kakoshi K.K.)
E: cast coat paper (Mirror Coat, available from Kanzaki Seishi K.K.)
F: cast coat paper (Mirror Coat, available from Kanzaki Seishi K.K.)

(C-5)

The procedure for obtaining the thermal transfer image receiving sheet (C-1) was repeated except for replacing the substrate sheet with a substrate sheet obtained by coating a 0.5% solution of an antistatic agent (Staticide, available from Analytichemical) on a surface of the same substrate sheet as used in the image receiving sheet (C-1) and drying the solution, to obtain a thermal transfer image receiving sheet (C-5) of the invention.

(C-6)

The procedure for obtaining the thermal transfer image receiving sheet (C-1) was repeated except for replacing the substrate sheet with a substrate sheet obtained by coating a 1% solution of polyvinyl alcohol (KL-05, available from Nippon Gosei Kagaku K.K.) on the back surface of the same substrate sheet as used in the image receiving sheet (C-1) and drying the solution, to obtain a thermal transfer image receiving sheet (C-6) of the invention.

The same thermal transfer sheet used in Example A was superposed on the receptor layer of each of the thermal transfer image receiving sheets (C-5), (C-6), (c-1) and (c-2), and they were subjected to a printing procedure using a thermal head under the conditions of an output of 1 W/dot, a puls width of 0.3 to 0.45 msec. and a dot density of 3 dot/mm to form cyan images.

Among the obtained color images, those obtained by using the thermal transfer image receiving sheets (C-5) and (C-6) were free from curling and static charge and showed high quality. As for the images of Comparison examples (c-1) and (c-2), marked curling occurred and a paper powder was easily attached because of static charge, and when a paper powder was deposited on the receptor layer, that portion had color dropout.

The fourth embodiment of the thermal transfer image receiving sheet of the invention comprises a substrate sheet, an intermediate layer and a dye receptor layer, as shown in FIG. 1. In this embodiment, further, either a pulp paper impregnated with an aqueous resin such as an emulsion or a pulp paper coated with aqueous resin is used as the substrate sheet. In such thermal transfer image receiving sheet, water retention characteristics of the substrate sheet is high, and thereby releasing and absorption of water content from the substrate sheet can be restrained, or the hydrophobic dye receptor layer can be made thin. As a result, curling caused by the environmental moisture variation and occurrence of paper powder can be restrained.

As the pulp paper substrate, there can be used various papers such as fine paper, art paper, coat paper, cast coat paper, thermal transfer paper and Kent paper. For obtaining ordinary paper-like texture properties, the thickness of the substrate sheet is preferably not more than 130 μm. Too small thickness causes problems in the strength and conveying properties in a printer, so that the lower limit is preferably approx. 50 μm.

Examples of aqueous resins to be impregnated in the pulp paper substrate or for forming the intermediate layer on the substrate include synthetic resins such as polyvinyl alcohol, polyacrylic acid soda, polyethylene glycol, watersoluble or hydrophilic polyester resin and polyurethane resin; and natural resins such as starch, casein and carboxymethyl cellulose. Further, the aqueous resin may be used in the form of an aqueous solution or an organic solvent solution. Moreover, the aqueous resin may be in the form of aqueous emulsion of a hydrophobic resin such as vinyl acetate/vinyl chloride copolymer, ethylene/vinyl acetate copolymer, acrylic resin and polyester resin. The impregnating amount or the coating amount of the aqueous resin preferably is in the range of 0.1 to 10 g/m$^2$ depending on the thickness of the pulp paper substrate. The impregnation may be carried out on one or both surfaces of the paper substrate. Further, the coating of the aqueous resin may be preferably carried out on back surface of the paper substrate, because absorption and evaporation of water content are liable to occur in the back surface.

When the impregnating amount or the coating amount is too small, anticurl effect is insufficient.

When the impregnating amount or the coating amount is too large, the back surface of the resulting thermal transfer image receiving sheet becomes sticky under the high moisture condition. The impregnation or the coating with the above resin may be conducted before or after the thermal transfer image receiving sheet is prepared. The above substrate sheet may be provided with an adhesive layer to enhance bonding strength with a dye receptor layer to be formed thereon.

The dye receptor layer provided on the abovementioned paper substrate sheet can be formed in the same manner as that for the dye receptor layer of the aforementioned first embodiment, so that detailed description thereof is omitted herein.

The thickness of the dye receptor layer is preferably in the range in the range of 0.1 to 5% based on the thickness of the thermal transfer image receiving sheet.

The above embodiment is described below in more concrete with reference to examples. In the examples, "part(s)" and "%" mean "part(s) by weight" and "% by weight", respectively, unless otherwise noted specifically.

EXAMPLE D

Onto a surface of a polyester film (Lumiror, available from Toray Industries, Inc.) having a thickness of 12 μm was applied a coating liquid for a receptor layer having the following composition in an amount of 3.0 g/m$^2$ (dry basis) using a bar coater. The coated layer was provisionally dried by means of a dryer, and then dried in an oven at 100° C. for 30 minutes to form a dye receptor layer. Further, onto the dye receptor layer was applied the following adhesive solution in an amount of 15 g/m$^2$ and dried to form an adhesive layer. Thus, a receptor layer transfer film was obtained.

| Composition of coating liquid for receptor layer | |
|---|---|
| Polyester resin (Bylon 103, available from Toyobo K.K.) | 100 parts |
| Amino modified silicone (KS-343, available from Shinetsu Kagaku Kogyo K.K.) | 3 parts |
| Epoxy modified silicone (KP-393, available from Shinetsu Kagaku Kogyo K.K.) | 3 parts |
| Methyl ethyl ketone/toluene (1/1 by weight) | 500 parts |
| **Composition of coating liquid for adhesive layer** | |
| Emulsion type adhesive (E-1054, available from Soken Kagaku K.K.) | 100 parts |
| Water | 30 parts |

(D-1)

The above receptor layer-transfer film was superposed on a copy paper (Xerox M paper, thickness: 90 μm), and they were laminated with each other by means of a laminatot. Then, the substrate film was released to transfer the dye receptor layer on the copy paper. Subsequently, the copy paper was impregnated with an anticurl coating liquid, namely, a 5% aqueous solution of polyvinyl alcohol (KL-05, available from Nippon Gosei Kagaku K.K.) in an amount of 2 g/m$^2$ (solid content) through coating and dried, to obtain a thermal transfer image receiving sheet (D-1) of the invention.

(D-2)

The procedure for obtaining the thermal transfer image receiving sheet (D-1) was repeated except for impregnating the copy paper with a 10% aqueous solution of polyethylene glycol (available from Sanyo Kasei K.K., average molecular weight: 400) as an anticurl liquid in an amount of 1 g/m$^2$ (solid content) through coating and then drying, to obtain a thermal transfer image receiving sheet (D-2) of the invention.

(D-3)

The procedure for obtaining the thermal transfer image receiving sheet (D-1) was repeated except for impregnating the copy paper with a 10% aqueous solution of starch as an anticurl liquid in an amount of 3 g/m$^2$ (solid content) through coating and then drying, to obtain a thermal transfer image receiving sheet (D-3) of the invention.

(D-4)

Onto a coat paper was applied a 15% aqueous solution of polyvinyl alcohol (KL-05, available from Nippon Gosei Kagaku K.K.) in an amount of 2 g/m$^2$ (solid content) and dried. Then, onto the surface was applied a coating liquid for a receptor layer having the following composition in an amount of 2.0 g/m$^2$ (dry basis). The coated layer was provisionally dried by means of a dryer, and then dried in an oven at 100° C. for 30 minutes to form a dye receptor layer. Thus, a thermal transfer image receiving sheet (D-4) of the invention was obtained.

| Composition of coating liquid for receptor layer | |
|---|---|
| Vinyl chloride/vinyl acetate copolymer (VYHD, available from Union Carbide) | 100 parts |
| Epoxy modified silicone (KF-393, available from Shinetsu Kagaku Kogyo K.K.) | 3 parts |
| Amino modified silicone (KS-343, available from Shinetsu Kagaku Kogyo K.K.) | 3 parts |
| Methyl ethyl ketone/toluene (1/1 by weight) | 500 parts |

(D-5)

Onto the surface of a polyester film (Lumiror, available from Toray Industries, Inc.) having a thickness of 12 μm was applied the same coating liquid for a receptor layer used in the above (D-4) in an amount of 2.0 g/m$^2$ (dry basis) using a bar coater. The coated layer was provisionally dried by means of a dryer, and then dried in an oven at 100° C. for 30 minutes to form a dye receptor layer. Further, onto the dye receptor layer was applied a hydrophilic polyurethane emulsion (X-143 available from Takeda Chemical Industries, Ltd.) in an amount of 1 g/m$^2$ and dried to form an intermediate layer. Thus, a receptor layer transfer film was obtained.

The receptor layer-transfer film was superposed on a surface of a fine paper, and they are laminated with each other by means of a laminator. Then, the substrate film was released to transfer the dye receptor layer and the intermediate layer. Thus, a thermal transfer image receiving sheet (D-5) of the invention was obtained.

(d-1)

The procedure for obtaining the thermal transfer image receiving sheet (D-1) was repeated except for not performing the anticurl treatment, to obtain a thermal transfer image receiving sheet (d-1) for comparison.

(d-2)

The procedure for obtaining the thermal transfer image receiving sheet (D-1) was repeated except for using a coat paper (available from Kanzaki Seishi K.K., thickness: 150 μm) as the substrate and not performing the anticurl treatment, to obtain a thermal transfer image receiving sheet (d-2) for comparison.

(d-3)

The procedure for obtaining the thermal transfer image receiving sheet (D-4) was repeated except for using a 15% methyl ethyl ketone/toluene solution of a polyester resin (Bylon 200, available from Toyobo K.K.) instead of the aqueous solution of polyvinyl alcohol, to obtain a thermal transfer image receiving sheet (d-3) for comparison.

(d-4)

The procedure for obtaining the thermal transfer image receiving sheet (D-5) was repeated except for using a 15% methyl ethyl ketone/toluene solution of acrylic adhesive (TO-3280, available from Dainippon Ink & chemicals Inc.) instead of the polyurethane type emulsion, to obtain a thermal transfer image receiving sheet (d-4) for comparison.

Each of the aboveobtained thermal transfer image receiving sheets (D-1) to (D-5), (d-1) to (d-4) was allowed to stand for 48 hours under the conditions of 40° C. and 20% RH and the conditions of 40° C. and 90% RH to examine occurrence of curling. The results are set forth in Table 4.

TABLE 4

| Thermal Transfer Image Receiving Sheet | 40° C., 20% RH | 40° C., 90% RH |
|---|---|---|
| D-1 | not curled | not curled |
| D-2 | not curled | not curled |
| D-3 | not curled | not curled |
| D-4 | not curled | not curled |
| D-5 | not curled | not curled |
| d-1 (Comparison Example) | markedly curled | markedly curled |
| d-2 (Comparison Example) | somewhat curled* | somewhat curled* |
| d-3 (Comparison Example) | markedly curled | markedly curled |
| d-4 (Comparison Example) | markedly curled | markedly curled |

*: The thermal transfer image receiving sheet lacks ordinary paperlike texture.

After the above curling test, the same thermal transfer sheet as used in Example A was superposed on the dye receptor layer of each thermal transfer image receiving sheet, and they were subjected to a printing procedure using a thermal head under the conditions of an output of 1 W/dot, a puls width of 0.3 to 0.45 msec. and a dot density of 3 dot/mm to form cyan images. In the case of using the thermal transfer image receiving sheets (D-1) to (D-5) of the invention, obtained were images of high quality free from defects such as color dropout, but in the case of using the thermal transfer image receiving sheets (d-1) to (d-4) for comparison, the obtained images had defects such as color dropout and were deteriorated in quality.

Figure 4:
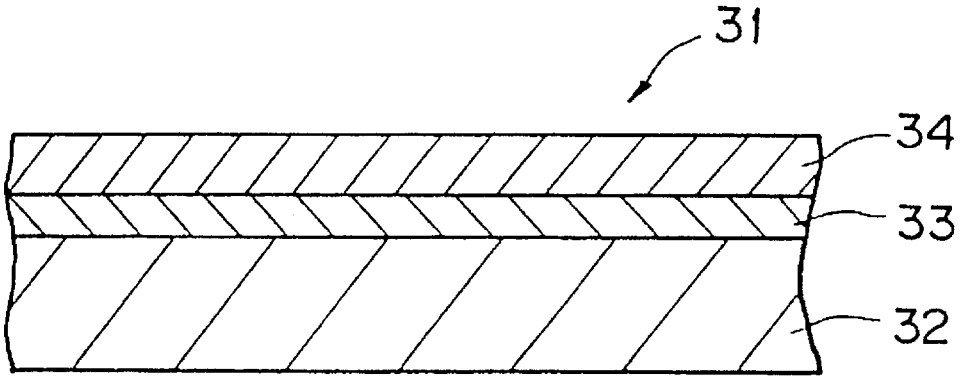
FIG. 4 is a schematic sectional view showing other example of the thermal transfer image receiving sheet according to the invention.

FIG. 4 is a schematic sectional view showing the fifth embodiment of the thermal transfer image receiving sheet according to the invention. In FIG. 4, the thermal transfer image receiving sheet 31 comprises a substrate sheet 32, an intermediate layer 33 provided on the substrate sheet, and a dye receptor layer 34 provided on the intermediate layer.

There is no specific limitation on the substrate sheet 32, and there can be employed, for example, any sheets or films of ordinary paper, fine paper, double-sided or single-sided coat paper, double-sided or single-sided art paper, double-sided or single-sided cast coat paper, synthetic paper, tracing paper and plastic film. For giving excellent ordinary paper-like texture to the resulting thermal transfer image receiving sheet, ordinary paper such as a conventional PPC paper can be used. If the bubble-containing layer, the intermediate layer and the dye receptor layer are formed by a coating method, coat paper (art paper) and cast coat paper are preferably used because those papers are hardly impregnated with the coating liquids.

The intermediate layer 33 provided on the substrate sheet may be formed any resins with the proviso that the resins are relatively high rigid. Preferred examples of the resins include acrylic resins, cellulose resins, polyester resins, polyurethane resins, polycarbonate resins and partially crosslinked resins thereof. As the acrylic resins having high rigidity, lower alkyl esters of (meth)acrylic acids such as polymethyl methacrylate and polymethyl acrylate are preferred. However, also employable are other acrylic resins at least a part of which is crosslinked by adding polyfunctional monomers such as divinyl benzene, ethylene glycol di(meth)acrylate, and trimethylol propane tri(meth)acrylate to other (meth)acrylic monomers. As the crosslinking methods, any methods such as method of using heat, ultraviolet rays, electron rays, etc. can be optionally employed. Preferred examples of the cellulose resins include ethylhydroxy cellulose, cellulose acetate propionate and CAB (available from Kodak).

The white pigments and fillers which can be added to the above resins are rigid solid particles, and examples thereof include inorganic fillers such as silica, alumina, clay, talc, calcium carbonate and barium sulfate; white pigments such as titanium oxide and zinc oxide; and resin particles (plastic pigments) such as particles of acrylic resin, epoxy resin, polyurethane resin, phenol resin, melamine resin, benzoguanamine resin, fluorine resin and silicone resin. By adding those fillers to the intermediate layer, sufficient rigidity can be given to the intermediate layer without thickening the layer. The amount of the filler used herein is preferably in the range of 10 to 600 wt. % based on the weight of the resin component contained the intermediate layer, whereby the rigidity of the intermediate layer can be much more enhanced.

The abovementioned resin and additives are dissolved or dispersed in an appropriate organic solvent such as acetone, ethyl acetate, methyl ethyl ketone, toluene, xylene and cyclohexanone to prepare a coating liquid or an ink, and the coating liquid or the ink is applied onto the bubblecontaining layer by means of a gravure printing, a screen printing, a reverse roll coating using a gravure plate, then dried, and if desired subjected to a crosslinking treatment, to form an intermediate layer. The thickness of the intermediate layer formed as above is preferably in the range of about 0.5 to 20 μm.

The dye receptor layer provided on the above intermediate layer can be formed in the same manner as that for the dye receptor layer of the aforementioned first embodiment, so that detailed description thereof is omitted herein.

In this embodiment, the surface of the dye receptor layer may be matted by providing extremely small sized protruded and depressed portions thereon, to further improve writing properties. Examples of preferred matting methods include a method of passing the image receiving sheet between the embossing roll and a nip roll and a method of passing the image receiving sheet and a shaping sheet having extremely small sized protruded and depressed portions on its surface together between nip rolls. For giving the dye receptor layer a similar texture to that of ordinary paper, an ordinary paper may be used as the shaping sheet.

The thermal transfer image receiving sheet having the above structure shows excellent writing properties, because the intermediate layer is formed from an acrylic resin of high rigidity or a resin at least a part of which is crosslinked as described above.

In this embodiment, the intermediate layer may have a two-layer structure by forming a cushioning layer between the substrate sheet 32 and the intermediate layer 33. The cushioning layer may be a layer made of a film having a relatively high elasticity or a layer containing bubbles.

Examples of resins for forming the elastic film include resins having Tg of not higher than 10° C., preferably in the range of −80° to 10° C., for example, polyurethane resin, polyester resin, acrylic resin, polyethylene resin, butadiene rubber, epoxy resin, vinyl chloride/vinyl acetate copolymer resin, polyamide resin, vinyl chloride, vinyl acetate, bipolymer or terpolymer resins of monomers such as ethylene and propylene, and ionomer.

To the cushioning layer made of such elastic film is preferably added additives such as a white pigment to enhance whiteness and a foaming agent (or expanding agent) or bubbles to improve cushioning properties, if desired. In the case where the cushioning layer contains the foaming agent or bubbles, even if the foaming agent or bubbles are excessively foamed or excessively expanded, the dye receptor layer does not have protruded and depressed portions or is not broken because a hard intermediate layer is provided on the cushinoing layer. The cushioning layer can be formed in the same manner as that for the aforementioned intermediate layer. The thickness of the cushioning layer is preferably approx. 0.5 to 30 μm or thereabout, and the total thickness of the intermediate layer and the cushioning layer is preferably 1 to 40 μm or thereabout.

The bubble-containing layer provided between the substrate sheet 32 and the intermediate layer 33 as the cushioning layer comprises bubbles and a binder. As the binder, any optional resins can be used, but preferred are heat-sensitive adhesives and heat-sensitive bonding agents (referred to as simply "adhesive(s)" hereinafter) having excellent adhesion to the substrate. Examples of the adhesives include two-pack hardening polyurethane adhesives as used for lamination of films in the prior art, adhesives for dry lamination made of epoxy resins, emulsions of vinyl acetate resin or acrylic resin for wet lamination, and hot melt adhesives of ethylene/vinyl acetate copolymer type, polyamide type, polyester type and polyolefin type.

Bubbles contained in those adhesives are formed using a foaming agent. As the foaming agent, there can be employed any conventional ones, for example, decomposition type foaming agents which are decomposed by heat to release gas such as oxygen, carbonic acid gas or nitrogen, concretely, dinitropentamethylene tetramine, diazoaminobenzene, azobisisobutylonitrile and azodicarboamide; microballoons obtained by encapsulating a lowboiling liquid such as butane or pentane with a resin such as polyvinylidene chloride or polyacrylonitrile. Also effectively employable are foamed (expanded) materials obtained by beforehand expanding those microballoons and microballoons coated with a white pigment. These foaming agents may be in the foamed, partially foamed or non-foamed state in the adhesive.

The foaming agent or the foamed material is preferably used so that the expanding ratio of the bubble-containing layer is in the range of about 1.5 to 20 times, for example, it is preferably used in an amount of 0.5 to 100 parts by weight per 100 parts by weight of the adhesive resin forming the bubble-containing layer. The foaming procedure of the foaming agent may be carried out before, during or after the formation of the bubble-containing layer. Further, it may be carried out in the preparation of the dye receptor layer-transfer film or may be carried out in the transferring procedure of the dye receptor layer. Also possible is that the foaming agent is transferred in the nonfoamed state together with the dye receptor layer on the substrate sheet, and then foamed by a heat of thermal head in the image formation stage. The time of foaming can be optionally determined depending on the kind of the used foaming agent, a temperature in the transferring stage of the dye receptor layer, etc.

The microcapsule expanding agent such as microspheres is particularly preferred, because the bubbles have outer walls even after expanded, and thereby defects such as pinholes are not brought about in the adhesive layer, intermediate layer and even the dye receptor layer.

When various fluorescent brighteners and white pigments such as titanium oxide are added to the bubble-containing layer in addition to the above foaming agent, the dye receptor layer can be enhanced in the whiteness after transferred. Therefore, if the substrate sheet is made of a paper, yellowness of the paper can be opacified. Of course, other optional additives such as an extender pigment and a filler can be added to the bubble-containing layer, if desired. The thickness of the bubble-containing layer is preferably in the range of 0.5 to 20 μm.

In the case where the intermediate layer has a substantially two-layer structure by providing a cushioning layer between the substrate sheet 32 and the intermediate layer 33 which is made of an acrylic resin and is relatively rigid, excellent writing properties and excellent printing properties can be obtained.

The above embodiment is described below in more concrete with reference to Examples E and F. In the examples, "part(s)" and "%" mean "part(s) by weight" and "% by weight", respectively, unless otherwise noted specifically.

EXAMPLE E

First, coating liquids having the following compositions were prepared.

| Composition of coating liquid for receptor layer | |
|---|---|
| Vinyl chloride/vinyl acetate copolymer (VYHD, available from Union Carbide) | 100 parts |
| Epoxy modified silicone (KF-393, available from Shinetsu Kagaku Kogyo K.K.) | 3 parts |
| Amino modified silicone (KP-343, available from Shinetsu Kagaku Kogyo K.K.) | 3 parts |
| Toluene/methyl ethyl ketone (1/1 by weight) | 500 parts |
| **Composition of coating liquid 1 for intermediate layer** | |
| Acrylic resin (BR-85, available from Mitsubishi Rayon K.K.) | 100 parts |
| Toluene/methyl ethyl ketone (1/1 by weight) | 400 parts |
| **Composition of coating liquid 2 for intermediate layer** | |
| Acrylic emulsion (Pegal 7505, available from Koatsu Gas Kogyo K.K.) | 100 parts |
| Pure water | 50 parts |

(E-1)

Next, the coating liquid 1 for an intermediate layer was applied onto a cast surface of a cast coat paper (New Coat Gold, available from Kanzaki Seishi K.K., basis weight: 84.9 g/m$^2$) in an amount of 1 g/m$^2$ (solid content) and dried, and then onto the surface was applied the coating liquid for a receptor layer in an amount of 9 g/m$^2$ (solid content) and dried, to form a dye receptor layer. Thus, a thermal transfer image receiving sheet (E-1) of the invention was obtained.

(E-2)

The coating liquid 2 for an intermediate layer was applied onto a coat surface of a coat paper (Daiya Coat, available from Jujo Seishi K.K., basis weight: 73.3 g/m$^2$) in an amount of 1 g/m$^2$ (solid content) and dried, then onto the surface was applied the coating liquid 1 for an intermediate layer in an amount of 3 g/m$^2$ (solid content) and dried, and further onto the surface was applied the coating liquid for a receptor layer in an amount of 6 g/m$^2$ (solid content) and dried, to form a dye receptor layer. Thus, a thermal transfer image receiving sheet (E-2) of the invention was obtained.

(E-3)

The procedure for obtaining the thermal transfer image receiving sheet (E-1) was repeated except for using an art paper (Chrome Dalart, available from Kanzaki Seishi K.K., basis weight: 127.9 g/m$^2$) instead of the cast coat paper, to obtain a thermal transfer image receiving sheet (E-3) of the invention.

(E-4)

The procedure for obtaining the thermal transfer image receiving sheet (E-1) was repeated except for applying a coating liquid for an intermediate layer having the following composition onto a cast surface of a cast coat paper (New Coat Gold, available from Kanzaki Seishi K.K., basis weight: 84.9 g/m$^2$) in an amount of 1 g/m$^2$ (solid content) and then curing the liquid by exposure of ultraviolet rays, to obtain a thermal transfer image receiving sheet (E-4) of the invention.

| Composition of coating liquid for intermediate layer | |
|---|---|
| Pentacrythritol tetraacrylate (SR-295, available from Sirtomer) | 20 parts |
| 2-ethylhexylmethacrylate (Light Ester EH, available from Kyoei Yushi Kagaku Kogyo K.K.) | 10 parts |
| 1-hydroxycyclohexylphenyl ketone (Irgacure 184, available from Nippon Ciba Geigy K.K.) | 1 part |
| Toluene/methyl ethyl ketone (1/1 by weight) | 100 parts |

(E-5)

The procedure for obtaining the thermal transfer image receiving sheet (E-1) was repeated except for applying a coating liquid for an intermediate layer having the following composition onto a cast surface of a cast coat paper (New Coat Gold, available from Kanzaki Seishi K.K., basis weight: 84.9 g/m$^2$) in an amount of 1 g/m$^2$ (solid content), drying and then crosslinked under heating, to obtain a thermal transfer image receiving sheet (E-5) of the invention.

| Composition of coating liquid for intermediate layer | |
|---|---|
| Polyester resin (Bylon 290, available from Toyobo K.K.) | 100 parts |
| Crosslinking agent (Sumidule N, available from Sumitomo Chemical Co., Ltd.) | 10 parts |
| Toluene/methyl ethyl ketone (1/1 by weight) | 100 parts |

(e-1)

As an comparison example, the coating liquid 2 for an intermediate layer was applied onto a surface of a coat paper (Daiya Coat, available from Jujo Seishi K.K., basis weight: 73.3 g/m$^2$) in an amount of 1 g/m$^2$ (solid content) and dried, and then onto the surface was applied the coating liquid for a receptor layer in an amount of 6 g/m$^2$ (solid content) and dried, to form a dye receptor layer. Thus, a thermal transfer image receiving sheet (e-1) for comparison was obtained.

Then, the same thermal transfer sheet as used in Example A was superposed on the dye receptor layer of each of the thermal transfer image receiving sheets (E-1) to (E-5) and (e-1), and they were subjected to a printing procedure using a thermal head under the conditions of an output of 1 W/dot, a puls width of 0.3 to 0.45 msec. and a dot density of 3 dot/mm to form cyan images. The results on the evaluation of the images are set forth in Table 5

TABLE 5

| Thermal Transfer Image Receiving Sheet | Appearance of sheet | Image Quality | Image Density | Writing Properties |
|---|---|---|---|---|
| E-1 | good | good | high | good |
| E-2 | good | good | high | good |
| E-3 | good | good | high | good |
| E-4 | good | good | high | good |
| E-5 | good | good | high | good |
| e-1 (Comparison Example) | good | good | high | bad |

EXAMPLE F

First, various coating liquids having the following compositions used for a thermal transfer image receiving sheet were prepared.

| Composition of coating liquid 1 for bubble-containing layer | |
|---|---|
| Polyester resin (Bylon 600, available from Toyo Boseki K.K.) | 100 parts |
| Expanding microcapsules (F-80, available from Matsumoto Yushi Seiyaku K.K.) | 10 parts |
| Ethyl acetate/isopropyl alcohol (1/1 by weight) | 400 parts |

| Composition of coating liquid 2 for bubble-containing layer | |
|---|---|
| Polyester resin (Bylon 600, available from Toyo Boseki K.K.) | 100 parts |
| Expanding microcapsules (F-80, available from Matsumoto Yushi Seiyaku K.K.) | 10 parts |
| Titanium oxide (TCA-888, available from Tochem Product) | 50 parts |
| Ethyl acetate/isopropyl alcohol (1/1 by weight) | 400 parts |

| Composition of coating liquid 3 for bubble-containing layer | |
|---|---|
| Acrylic emulsion (E-1000, available from Soken Kagaku K.K.) | 100 parts |
| Expanding microcapsules (F-80, available from Matsumoto Yushi Seiyaku K.K.) | 30 parts |
| Pure water | 50 parts |

| Composition of coating liquid 1 for intermediate layer | |
|---|---|
| Acrylic resin (BR-88, available from Sekisui Kagaku K.K.) | 100 parts |
| Tolune/methyl ethyl ketone (1/1 by weight) | 400 parts |

| Composition of coating liquid 2 for intermediate layer | |
|---|---|
| Acrylic resin (BR-88, available from Sekisui Kagaku K.K.) | 100 parts |
| Titanium oxide (TCA-888, available from Tochem Product) | 50 parts |
| Tolune/methyl ethyl ketone (1/1 by weight) | 400 parts |

| Composition of coating liquid 3 for intermediate layer | |
|---|---|
| Acrylic resin (BR-88, available from Sekisui Kagaku K.K.) | 100 parts |
| Toluene/methyl ethyl ketone (1/1 by wight) | 400 parts |

| Composition of coating liquid 4 for intermediate layer | |
|---|---|
| Cellulose resin (CAB, available from Kodak) | 100 parts |
| Calcium carbonate | 50 parts |
| Toluene/methyl ethyl ketone (1/1 by weight) | 400 parts |

| Composition of coating liquid 5 for intermediate layer | |
|---|---|
| Ethylhydroxy cellulose | 100 parts |
| Titanium oxide (TCA-888, available from Tochem Pfroduct) | 50 parts |
| Toluene/methyl ethyl ketone (1/1 by weight) | 400 parts |

| Composition of coating liquid 6 for intermediate layer | |
|---|---|
| Polyester resin (Bylon 290, available from Toyo Boseki K.K.) | 100 parts |
| Silica | 20 parts |
| Alumina | 20 parts |
| Toluene/methyl ethyl ketone (1/1 by weight) | 400 parts |

| Composition of coating liquid 7 for intermediate layer | |
|---|---|
| Acrylic resin (Acrylic 52-666, available from Dai Nippon Ink K.K.) | 100 parts |
| Curing agent (isocyanate) (Barnock DN-955, available from Dai Nippon Ink K.K.) | 20 parts |
| Toluene/methyl ethyl ketone (1/1 by weight) | 400 parts |

| Composition of coating liquid 1 for dye receptor layer | |
|---|---|
| Vinyl chloride/vinyl acetate copolymer (#1000D, available from Denki Kagaku Kogyo K.K.) | 100 parts |
| Amino modified silicone (X-22-343, available from Shinetsu Kagaku Kogyo K.K.) | 3 parts |
| Epoxy modified silicone (KF-393, available from Shinetsu Kagaku Kogyo K.K.) | 3 parts |
| Methyl ethyl ketone/toluene (1/1 by weight) | 500 parts |

| Composition of coating liquid 2 for dye receptor layer | |
|---|---|
| Vinyl chloride/vinyl acetate copolymer (VYHD, available from Union Carbide) | 100 parts |
| Epoxy modified silicone (KF-393, available from Shinetsu Kagaku Kogyo K.K.) | 3 parts |

-continued

| | |
|---|---|
| Amino modified silicone (KF-343, available from Shinetsu Kagaku Kogyo K.K.) | 3 parts |
| Antistatic agent (Plysurf A208B, available from Daiichi Kogyo Seiyaku K.K.) | 2 parts |
| Methyl ethyl ketone/toluene (1/1 by weight) | 500 parts |

(F-1)

Next, the coating liquid 1 for a bubble-containing layer was applied onto one surface of a cast coat paper (Mirror Gold, available from Kanzaki Seishi K.K.) having a thickness of 90 μm in such an amount that the dry thickness of the resulting layer would be 15μ and dried, then onto the bubble-containing layer was applied the coating liquid 1 for an intermediate layer in such an amount that the dry thickness of the resulting layer would be 3μ and dried, and then onto the intermediate layer was applied the coating liquid 1 for a receptor layer in such an amount that the dry thickness of the resulting layer would be 3μ and dried, to obtain a thermal transfer image receiving sheet (F-1) of the invention.

(F-2)–(F-9)

The procedure for obtaining the thermal transfer image receiving sheet (F-1) was repeated except for using coating liquids set forth in Table 6, to obtain thermal transfer image receiving sheets (F-2) to (F-9) of the invention.

TABLE 6

| Thermal Transfer Image Receiving Sheet | Bubble-containing Layer (μm) | Intermediate Layer (μm) | Dye Receptor Layer (μm) |
|---|---|---|---|
| F-2 | coating liquid 2 (15) | coating liquid 2 (3) | coating liquid 2 (5) |
| F-3 | coating liquid 1 (15) | coating liquid 1 (3) | coating liquid 2 (5) |
| F-4 | coating liquid 1 (15) | coating liquid 2 (3) | coating liquid 2 (5) |
| F-5 | coating liquid 2 (15) | coating liquid 1 (3) | coating liquid 1 (5) |
| F-6 | coating liquid 1 (15) | coating liquid 4 (3) | coating liquid 2 (5) |
| F-7 | coating liquid 2 (15) | coating liquid 5 (3) | coating liquid 1 (5) |
| F-8 | coating liquid 1 (15) | coating liquid 6 (3) | coating liquid 1 (5) |
| F-9 | coating liquid 1 (15) | coating liquid 7 (3) | coating liquid 2 (5) |

(F-10)

Onto a surface of a polyester film (Lumiror, available from Toray Industries, Inc.) having a thickness of 12 μm was applied the aforementioned coating liquid 1 for a dye receptor layer in an amount of 3.0 g/m$^2$ (dry basis) using a bar coater and dried. Onto the layer was applied the coating liquid 2 for an intermediate layer in such an amount that the dry thickness of the resulting layer would be 15 μm and dried, and then onto the intermediate layer was further applied the coating liquid 2 for a bubble-containing layer in such an amount that the dry thickness of the resulting layer would be 15 μm and dried, to obtain a receptor layer-transfer film.

The receptor layer-transfer film was superposed on a surface of a cast coat paper (Mirror Gold, available from Kanzaki Seishi K.K.), and they were laminated with each other by means of a laminator. Then, the substrate film (polyester film) was released to obtain a thermal transfer image receiving sheet (F-10) of the invention.

(F-11)–(F-13)

The procedure for obtaining the thermal transfer image receiving sheet (F-10) was repeated except for using substrate sheets set forth in Table 7, to obtain thermal transfer image receiving sheets (F-11) to (F-13) of the invention.

TABLE 7

| Thermal Transfer Image Receiving Sheet | Substrate Sheet |
|---|---|
| F-11 | thermal transfer paper (TRW-C2, available from JuJo Seishi K.K.) |
| F-12 | single-sided coat paper (available from JuJo Seishi K.K.) |
| F-13 | copy paper (Canon PPC, available from Canon K.K.) |

(f-1)

The procedure for obtaining the thermal transfer image receiving sheet (F-1) was repeated except for not forming an intermediate layer, to obtain thermal transfer image receiving sheet (f-1) for comparison.

(f-2)

The procedure for obtaining the thermal transfer image receiving sheet (F-1) was repeated except for not forming a bubble-containing layer and an intermediate layer, to obtain thermal transfer image receiving sheet (f-2) for comparison.

Then, the same thermal transfer sheet as used in Example A was superposed on the dye receptor layer of each of the thermal transfer image receiving sheets (F-1) to (F-13), (f-1) and (f-2), and they were subjected to a printing procedure using a thermal head under the conditions of an output of 0.2 W/dot, a puls width of 12 msec. and a dot density of 6 dot/mm to form cyan images. The results on the evaluation of the images are set forth in Table 8

TABLE 8

| Thermal Transfer Image Receiving Sheet | Surface Strength | Image Quality |
|---|---|---|
| F-1 | ○ | color dropout, partial breakage: not observed |
| F-2 | ○ | color dropout, partial breakabe: not observed |
| F-3 | ○ | color dropout, partial breakage: not observed |
| F-4 | ○ | color dropout, partial breakabe: not observed |
| F-5 | ○ | color dropout, partial breakage: not observed |
| F-6 | ○ | color dropout, partial breakabe: not observed |
| F-7 | ○ | color dropout, partial breakage: not observed |
| F-8 | ○ | color dropout, partial breakabe: not observed |
| F-9 | ○ | color dropout, partial breakage: not observed |
| F-10 | ○ | color dropout, partial breakabe: not observed |
| F-11 | ○ | color dropout, partial breakage: not observed |
| F-12 | ○ | color dropout, partial breakage: not observed |
| F-13 | ○ | color dropout, partial breakage: not observed |

TABLE 8-continued

| Thermal Transfer Image Receiving Sheet | Surface Strength | Image Quality |
|---|---|---|
| f-1 (Comparison Example) | x | color dropout, partial breakage: not obserbed |
| f-2 (Comparison Example) | Δ | color dropout, partial breakage: observed |

Surface strength in Table 8 was evaluated by a writing test with an automatic pencil (hardness: HB) in accordance with the following evaluation basis.

○: Writing properties are good.

Δ: The written letters are faint.

x: The dye receptor layer is scraped off.

The sixth embodiment of the thermal transfer image receiving sheet according to the invention comprises a substrate sheet, an intermediate layer provided thereon and a dye receptor layer provided on the intermediate layer, and the intermediate layer is composed of a chlorinated polypropylene resin.

The substrate sheet of the above-mentioned thermal transfer image receiving sheet may be any of the substrate sheets described before.

The chlorinated polypropylene resin for forming the intermediate layer on a surface of the substrate sheet may be either low-chlorinated or high-chlorinated, but particularly preferred is a low-chlorinated polypropylene having chlorine content of 20 to 40 wt. %. The chlorinated polypropylene may be those having been subjected to various modification, such as maleic acid modified, alcohol modified and epoxy modified chlorinated polypropylene. The intermediate layer in the invention may be formed from a mixture of a chlorinated polyproylene and other resin such as acrylic resin, urethane resin, polyester resin, vinyl chloride resin, vinyl acetate resin and ethylene/vinyl acetate copolymer. In this case, the amount of the chlorinated polypropylene is preferably not less than 10 wt. % of the total amount. The intermediate layer can be formed by various methods such as a gravure coating, a screen printing and a cast coat method, without limiting thereto.

The intermediate layer may contain a white pigment, a filler and/or a fluorescent brightener, likewise the aforementioned other embodiments. For introducing the white pigment or others into the intermediate layer, they are added to the coating liquid used for the formation of the intermediate layer.

The white pigment or the filler serves to improve whiteness and opacifying power of the intermediate layer and to prevent adverse effects by a color of the substrate sheet on the obtained image. Examples of the white pigments and the fillers include titanium oxide, zinc oxide, caolin clay, calcium carbonate and particulate silica. The amount of the white pigment or the like is generally in the range of 1 to 500 parts by weight based on 100 parts by weight of the resin used for the intermediate layer, though it varies depending on the kinds of the used pigment or the like.

The fluorescent brightener serves to eliminate yellowness of the resin of the intermediate layer and to enhance whiteness, and employable are conventional fluorescent brighteners of stilbene type, diaminodiphenyl type, oxazole type, imidazole type, thiazole type, coumarin type, naphthalimide type, thiophene type, etc. The fluorescent brightener is dissolved in a resin for the intermediate layer, and it shows satisfactory effect in an extremely low concentration, for example, a concentration of 0.01 to 5 wt. %.

The dye receptor layer provided on the substrate sheet can be formed in the same manner as that for the dye receptor layer in the aforementioned first embodiment, so that detailed description thereof is omitted herein.

As described in the above thermal transfer image receiving sheets, a thermal transfer image receiving sheet having high adhesion between the substrate sheet and the dye receptor layer and having excellent cushioning properties can be obtained by forming the intermediate layer from the chlorinated polypropylene.

The above embodiment is described below in more concrete with reference to examples. In the examples, "part(s)" and "%" mean "part(s) by weight" and "% by weight", respectively, unless otherwise noted specifically.

EXAMPLE G (G-1)

Onto a surface of a synthetic paper (trade name: Yupo, available from Oji Yuka K.K.) having a thickness of 200 μm was applied a coating liquid for an intermediate layer having the following composition in an amount of 1.0 g/m$^2$ (dry basis) using a bar coater, then dried by means of a dryer, and further dried in an oven at 100° C. for 5 minutes to form an intermediate layer. Onto the intermediate layer was applied a coating liquid for a receptor layer having the following composition in an amount of 3.0 g/m$^2$ and dried in an oven at 100° C. for 5 minutes, to obtain a thermal transfer image receiving sheet (G-1) of the invention.

| Composition of coating liquid for intermediate layer | |
|---|---|
| Chlorinated polypropylene (Hardren 13B, available from Toyo Kasei K.K.) | 50 parts |
| Ethylene/vinyl acetate copolymer (Everflex 40Y, available from Mitsui Dupont Chemical K.K.) | 50 parts |
| Fluorescent brightener (Ubitex OB, available from Ciba Geigy) | 0.1 part |
| Toluene | 100 parts |
| **Composition of coating liquid for receptor layer** | |
| Polyester resin (Bylon 103, available from Toyobo K.K.) | 100 parts |
| Amino modified silicone (X-22-343, available from Shinetsu Kagaku Kogyo K.K.) | 3 parts |
| Epoxy modified silicone (KF-393, available from Shinetsu Kagaku Kogyo K.K.) | 3 parts |
| Methyl ethyl ketone/toluene (1/1 by weight) | 500 parts |

(G-2)

Onto a foamed polypropylene sheet (Toyopearl SS#35, available from Toyobo K.K., thickness: 35 μm) was applied a coating liquid for an intermediate layer having the following composition in an amount of 2.0 g/m$^2$ (solid content) using a bar coater and dried. Then, onto the surface was applied a coating liquid for a receptor layer having the following composition in an amount of 2.0 g/m$^2$, then dried by means of a dryer and further dried in an oven. at 100° C. for 30 minutes, to obtain a thermal transfer image receiving sheet (G-2) of the invention.

| Composition of coating liquid for intermediate layer | |
|---|---|
| Chlorinated polypropylene (Hardren 15LPB, available from Toyo Kasei K.K.) | 100 parts |
| Titanium oxide (TCR-10, available from Tochem Product) | 100 parts |
| Toluene | 100 parts |

-continued

| Composition of coating liquid for receptor layer | |
|---|---|
| Vinyl chloride/vinyl acetate copolymer resin (VYHD, available from Union Carbide) | 100 parts |
| Epoxy modified silicone (KF-393, available from Shinetsu Kagaku Kogyo K.K.) | 3 parts |
| Amino modified silicone (KP-343, available from Shinetsu Kagaku Kogyo K.K.) | 3 parts |
| Methyl ethyl ketone/toluene (1/1 by weight) | 400 parts |

(G-3)

Onto a surface of a polyester film (trade name: Lumiror, available from Toray Industries, Inc.) having a thickness of 100 μm was applied a coating liquid for an intermediate layer having the following composition in an amount of 3.0 g/m$^2$ (dry basis) using a bar coater and dried by means of a dryer, to form an intermediate layer. Onto the intermediate layer was applied a coating liquid for a receptor layer having the following composition in an amount of 4.0 g/m$^2$ (dry basis) using a bar coater and dried, to obtain a thermal transfer image receiving sheet (G-3) of the invention.

| Composition of coating liquid for intermediate layer | |
|---|---|
| Chlorinated polypropylene (Hardren 15LPB, available from Toyo Kasei K.K.) | 50 parts |
| Titanium oxide (TCA888, available from Tochem Product) | 100 parts |
| Toluene | 100 parts |
| **Composition of coating liquid for receptor layer** | |
| Vinyl chloride/vinyl acetate copolymer resin (VYHD, available from Union Carbide) | 100 parts |
| Amino modified silicone (K-22-343, available from Shinetsu Kagaku Kogyo K.K.) | 2 parts |
| Epoxy modified silicone (KF-393, available from Shinetsu Kagaku Kogyo K.K.) | 2 parts |
| Methyl ethyl ketone/toluene (1/1 by weight) | 100 parts |

(g-1)

The procedure for obtaining the thermal transfer image receiving sheet (G-1) was repeated except for using the following thermoplastic resin solution as the coating liquid for an intermediate layer, to obtain a thermal transfer image receiving sheet (g-1) for comparison.

| Composition of coating liquid for intermediate layer | |
|---|---|
| Acrylic resin (Daiyanal BR85, available from Mitsubishi Rayon K.K.) | 20 parts |
| Toluene | 100 parts |

(g-2)

The procedure for obtaining the thermal transfer image receiving sheet (G-2) was repeated except for not forming an intermediate layer, to obtain a thermal transfer image receiving sheet (g-2) for comparison.

The same thermal transfer sheet as used in Example A was superposed on the dye receptor layer of each of the thermal transfer image receiving sheets (G-1) to (G-3), (g-1) and (g-2), and they were subjected to a printing procedure using a thermal head under the conditions of an output of 1 W/dot, a puls width of 0.3 to 0.45 msec. and a dot density of 3 dot/mm to form cyan images. In the case of using the thermal transfer image receiving sheets (G-1) to (G-3) of the invention, the dye receptor layers were free from problem of peeling, and images of high quality free from defects such as color dropout were obtained. On the other hand, in the case of using the thermal transfer image receiving sheets (g-1) and (g-2) for comparison, the dye receptor layers were partially peeled off, and some images were of low quality because of defects such as color dropout.

The seventh embodiment of the thermal transfer image receiving sheet of the invention comprises a substrate sheet, an intermediate layer provided thereon and a dye receptor layer provided on the intermediate layer, and the intermediate layer is composed of a resin having a glass transition temperature of −80° to 20° C.

The substrate sheet in the above-mentioned thermal transfer image receiving sheet may be any of the substrate sheets described before.

Examples of the resin having a glass transition temperature of −80° to 20° C. and for forming the intermediate layer on the substrate sheet include urea resin (adhesive of this type), melamine resin (adhesive of this type), phenol resin (adhesive of this type), epoxy resin (adhesive of this type), vinyl acetate resin, cyanoacrylate type adhesive, polyurethane type adhesive, α-olefin/maleic anhydride resin (adhesive of this type), aqueous polymer/isocyanate type adhesive, reaction type acrylic resin adhesive, modified acrylic resin adhesive, vinyl chloride resin, silicone resin type adhesive, polyester resin type adhesive, vinyl acetate resin type or its copolymer emulsion type adhesive, ethylene/vinyl acetate copolymer resin emulsion type adhesive, acrylic resin emulsion type adhesive, polyurethane emulsion type adhesive, styrene/acrylic emulsion type adhesive, natural rubber type emulsion, silicone rubber type emulsion, chloroprene rubber (solvent type adhesive), synthetic rubber (solvent type adhesive), synthetic rubber latex type adhesive and epoxy resin type emulsion.

When the glass transition point is lower than −80° C., the dye receptor layer is reduced in scratch resistance because the intermediate layer is too soft. When the glass transition point is higher than 20° C., cushioning properties in the printing procedure is insufficient to decrease printed image quality, and further heating of a certain level is necessary in the preparation of the image receiving sheet.

One preferred process for forming the intermediate layer is so-called "transfer process". In this process, a receptor layer of uniform thickness (approx. 1 to 3 μm on dry basis) is initially formed on a polyester film. Onto the sufficiently dried receptor layer is applied the abovementioned resin in such an amount that the dry thickness of the resulting layer would be approx. 1 to 20 μm and dried to form an intermediate layer. If the intermediate layer is formed from an aqueous emulsion, the layer is sufficiently dried to remove water content. Then, the intermediate layer is adhered to the substrate (e.g., paper) of the image receiving sheet using a roller or the like under pressure (and under heating if desired), and thereafter the above polyester film is released from the receptor layer. The formation of the intermediate layer in the invention is not limited to this process, and any other processes such as a coating process can be employed.

The intermediate layer may contain a white pigment, a filler and/or a fluorescent brightener as in the intermediate layer of the aforementioned sixth embodiment.

The dye receptor layer provided on the intermediate layer can be formed in the same manner as that for the dye receptor layer of the aforementioned first embodiment, and detailed description thereof is omitted herein.

By forming the intermediate layer from the resin having a glass transition temperature ranging from −80° to 20° C. as described above, a thermal transfer image receiving sheet excellent in cushioning properties can be obtained.

The above embodiment is described below in more concrete with reference to example. In the example, "part(s)" and "%" mean "part(s) by weight" and "% by weight", respectively, unless otherwise noted specifically.

EXAMPLE H

Onto a surface of a polyester film (trade name: Lumiror, available from Toray Industries, Inc.) having a thickness of 12 μm was applied a coating liquid for a receptor layer having the following composition in an amount of 3.0 g/m$^2$ (dry basis) using a bar coater. The coated layer was provisionally dried by means of a dryer and further dried in an oven at 100° C. for 30 minutes to form a receptor layer. Onto the receptor layer was applied a coating liquid (adhesive solution) for an intermediate layer having the following composition in an amount of 15 g/m$^2$ using a bar coater and dried, to form an adhesive layer. Thus, a receptor layer-transfer film was obtained.

| Composition of coating liquid for receptor layer | |
|---|---|
| Polyester resin (Bylon 103, available from Toyobo K.K.) | 100 parts |
| Amino modified silicone (X-22-343, available from Shinetsu Kagaku Kogyo K.K.) | 3 parts |
| Epoxy modified silicone (KF-393, available from Shinetsu Kagaku Kogyo K.K.) | 3 parts |
| Methyl ethyl ketone/toluene (1/1 by weight) | 500 parts |
| Composition of coating liquid for intermediate layer | |
| Emulsion type adhesive (E-1054, available from Soken Kagaku K.K., glass transition point: −50° C.) | 100 parts |
| White pigment (titanium oxide, TCA888, available from Tochem Products) | 20 parts |
| Water | 30 parts |

(H-1)

Next, the above receptor layer-transfer film was superposed on a copy paper (Zerox M paper, thickness: 90 μm), and they were laminated with each other using a laminator. Then, the substrate film was released to transfer the dye receptor layer and the interemediate layer, to obtain a thermal transfer image receiving sheet (H-1) of the invention.

(H-2)

Onto a coat paper was applied a coating liquid for an intermediate layer having the following composition in an amount of 2 g/m$^2$ (solid content) and dried. Onto the surface was applied a coating liquid for a receptor layer having the following composition in an amount of 2.0 g/m$^2$ (dry basis) using a bar coater. The coated layer was provisionally dried by means of a dryer and further dried in an oven at 100° C. for 30 minutes to form a receptor layer. Thus, a thermal transfer image receiving sheet (H-2) of the invention was obtained.

| Composition of coating liquid for intermediate layer | |
|---|---|
| Acrylic emulsion type adhesive (AE-120, available from Japan Synthetic Rubber Co., Ltd., glass transition point: 0° C.) | 100 parts |
| White pigment (titanium oxide, TCA888, available from Tochem Products) | 20 parts |
| Water | 30 parts |
| Composition of coating liquid for receptor layer | |
| Vinyl chloride/vinyl acetate copolymer resin (VYHD, available from Union Carbide) | 100 parts |
| Epoxy modified silicone (KF-393, available from Shinetsu Kagaku Kogyo K.K.) | 3 parts |
| Amino modified silicone (KF-343, available from Shinetsu Kagaku Kogyo K.K.) | 3 parts |
| Methyl ethyl ketone/toluene (1/1 by weight) | 400 parts |

(H-3)

Onto a surface of a polyester film (trade name: Lumiror, available from Toray Industries, Inc.) having a thickness of 12 μm was applied a coating liquid for a receptor layer having the following composition in an amount of 2.0 g/m$^2$ (dry basis) using a bar coater. The coated layer was provisionally dried by means of a dryer and further dried in an oven at 100° C. for 30 minutes to form a dye receptor layer. Onto the receptor layer was applied a coating liquid for an intermediate layer having the following composition in an amount of 1 g/m$^2$ (dry basis) using a bar coater and dried, to form an intermediate layer. Thus, a receptor layer-transfer film was obtained.

| Composition of coating liquid for receptor layer | |
|---|---|
| Vinyl chloride/vinyl acetate copolymer resin (VYHD, available from Union Carbide) | 100 parts |
| Epoxy modified silicone (KF-393, available from Shinetsu Kagaku Kogyo K.K.) | 3 parts |
| Amino modified silicone (KP-343, available from Shinetsu Kagaku Kogyo K.K.) | 3 parts |
| Methyl ethyl ketone/toluene (1/1 by weight) | 400 parts |
| **Composition of coating liquid for intermediate layer** | |
| Ethylene/vinyl acetate copolymer emulsion type adhesive (XC-3940C, available from Toa Paint K.K., glass transition point: −20° C.) | 100 parts |
| White pigment (titanium oxide, TCA888, available from Tochem Products) | 20 parts |
| Water | 30 parts |

The above receptor layer-transfer film was superposed on a surface of a fine paper, and they were laminated with each other by means of a laminator. Then, the substrate film was released to transfer the dye receptor layer and the intermediate layer, to obtain a thermal transfer image receiving sheet (H-3) of the invention.

(h-1)

The procedure for obtaining the thermal transfer image receiving sheet (H-1) was repeated except for using the following thermoplastic resin solution as a resin for forming an intermediate layer, to obtain a thermal transfer image receiving sheet (h-1) for comparison.

| Thermoplastic resin solution | |
|---|---|
| Vinyl chloride/vinyl acetate copolymer resin (MT3; available from Denki Kagaku Kogyo K.K., glass transition point: 55° C.) | 100 parts |
| Methyl ethyl ketone/toluene (1/1 by weight) | 100 parts |

(h-2)

The procedure for obtaining the thermal transfer image receiving sheet (H-2) was repeated except for not forming an intermediate layer, to obtain a thermal transfer image receiving sheet (h-2) for comparison.

The same thermal transfer sheet as used in Example A was superposed on the dye receptor layer of each of the thermal transfer image receiving sheets (H-1) to (H-3), (h-1) and (h-2), and they were subjected to a printing procedure using a thermal head under the conditions of an output of 1 W/dot, a puls width of 0.3 to 0.45 msec. and a dot density of 3 dot/mm to form cyan images. In the case of using the thermal transfer image receiving sheets (H-1) to (H-3) of the invention, images of high quality free from defects such as color dropout were obtained. On the other hand, in the case of using the thermal transfer image receiving sheets (h-1) and (h-2) for comparison, the obtained images had defects such as color dropout and were deteriorated in the quality.

Figure 5:
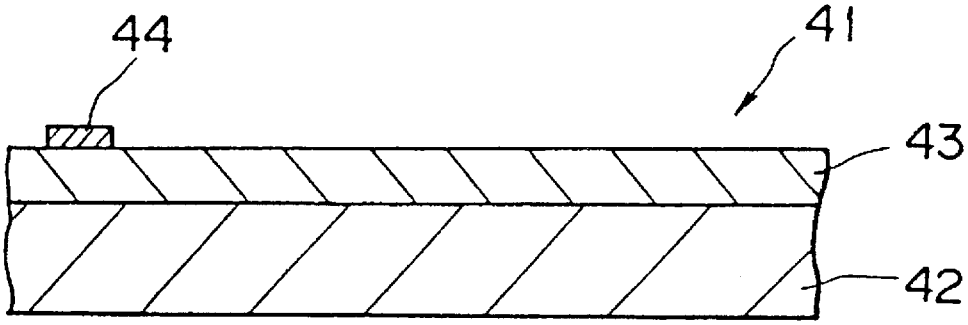
FIG. 5 is a schematic sectional view showing other example of the thermal transfer image receiving sheet according to the invention.

FIG. 5 is a schematic sectional view showing the eighth embodiment of the thermal transfer image receiving sheet according to the invention. In FIG. 5, the thermal transfer image receiving sheet 41 comprises a substrate sheet 42 and a dye receptor layer 43 provided on at least one side surface (only one side surface in the figure) of the substrate 42, and at least one of the front and back surfaces (front surface in the figure) of the image receiving sheet has a detection mark 44.

As the substrate sheet 42, any substrate sheets exemplified in the aforementioned each embodiments can be employed.

The dye receptor layer 43 provided on a surface of the substrate sheet can be formed in the same manner as that for the receptor layer of the aforementioned first embodiment, so that detailed description thereof is omitted herein.

The detection mark 44 provided on at least one surface side of the thermal transfer image receiving sheet 41 is formed, for example, from an ink containing such a material as is hardly discriminated with the naked eye but is highly sensitive to a specific wavelength, such as a fluorescent material or an infrared absorbent.

Examples or the fluorescent materials include conventional fluorescent brighteners of stilbene type, diaminodiphenyl type, oxazole type, imidazole type, thiazole type, coumarin type, naphthalimide type, thiophene type, etc. and inorganic fluorescent materials which are sensitive to ultraviolet rays.

Examples of the infrared absorbents include IR-820 and CY-9 (both available from Nippon Kayaku K.K.); F2GS (available from Bayer); Braun GGL Stab, Braun RG Stab, Rot GGF Stab, Blau FG Stab, Blau R Stab, Blau 3R Stab, Grun B Stab, Oliv HG Stab, Grau BS Stab and Schwarz CLStab (all available from Hechist); and Green G, OPTOGEN NIR-760, OPTOGEN NIR-810, OPTOGEN NIR-830, OPTOGEN NIR-840S, OPTOGEN DIR-980 and OPTOGEN DIR-100 (all available from Sumitomo Chemical Co., Ltd.).

In the case where the substrate sheet 42 of the thermal transfer image receiving sheet 41 is a paper, the detection mark provided on the paper substrate can be formed froln an ink containing an ultraviolet absorbent, because the paper generally contains a fluorescent brightener. Examples of the ultraviolet absorbents include those of salicylic acid type, benzophenone type, benzotriazole type, cyanoacrylate type, etc. In concrete, there can be employed commercially available ones such as Tinuvin P, Tinubin 234, Tinuvin 320, Tinvin 326, Tinuvin 327, Tinuvin 328, Tinuvin 312 and Tinuvin 315 (all produced by Ciba Geigy); Sumisorb-110, Sumisorb-130, Sumisorb-140, Sumisorb-200, Sunisorb-250, Sumisorb-300, Sumisorb-320, Sumisorb-340, Sumisorb-350 and Sumisorb-400 (all produced by Sumitomo Chemical Co., Ltd.); and Mark LA-32, Mark LA-36 and Mark 1413 (all produced by Adeca Argas Kagaku K.K.).

The detection mark can be formed from a magnetic material. A magnetic material is usually colored brown to black, so that the detection mark made of such magnetic material is preferably formed between the substrate sheet and the dye receptor layer in the preparation of the thermal transfer image receiving sheet. In this case, the detection mark made of the magnetic material becomes inconspicuous by incorporating a white pigment having high opecifying properties into the dye receptor layer. Examples of the magnetic materials include iron, chromium, nickel, cobalt, alloys thereof, oxides thereof, and modified products thereof, concretely, $\gamma$-$Fe_2O_3$, ferrite, magnetite, $CrO_2$ and bertholide compounds of $\gamma$-$Fe_2O_3$ doped with cobalt and $Fe_3O_4$.

The material mentioned as above is dissolved or dispersed in an medium of a conventional gravure ink, and using the solution or the dispersion, a mark of optional shape is printed by an optional printing means such as a gravure printing, to form a detection mark.

By appropriately selecting the substrate sheet 42, the image receiving sheet 41 of this embodiment can be applied to various uses such as image receiving sheets of separate sheet type or continuous sheet type, cards, drafting sheets of transmission type, all capable of being recorded with information by a thermal transfer method.

Further, the image receiving sheet 41 of this embodiment can be provided with an intermediate layer (cushioning layer) between the substrate sheet 42 and the dye receptor layer 43. By the virtue of the intermediate layer (cushioning layer), an image almost free from noise in a printing procedure and corresponding to the image information can be transferred and recorded with high reproducibility.

A material for forming the cushioning layer may be appropriately selected from various materials exemplified for the intermediate layer of the aforementioned embodiments.

On the back surface of the substrate sheet 42 may be provided a slip layer. Examples of the slip layer materials include methacylate resins such as methyl methacrylate, acrylic resins corresponding thereto, and vinyl resins such as a vinyl chloride/vinyl acetate copolymer.

By forming the front and back surface detection mark which is distinguishable with the naked eye or is inconspicuous on at least one surface of the front and back surfaces of the thermal image receiving sheet, the thermal image receiving sheet can be easily distinguished between its front and back surfaces and can give an image of good appearance.

The above embodiment is described below in more concrete with reference to examples. In the examples, "part(s)" and "%" mean "part(s) by weight" and "% by weight", respectively, unless otherwise noted specifically.

EXAMPLE I (I-1)

Onto a surface of a polyester film (trade name: Lumiror, available from Toray Industries, Inc.) having a thickness of 15 μm was applied a coating liquid for a receptor layer having the following composition in an amount of 5.0 g/m$^2$ (dry basis) using a bar coater. The coated layer was provisionally dried by means of a dryer and further dried in an oven at 100° C. for 30 minutes to form a dye receptor layer. Onto the receptor layer was applied the following adhesive solution in an amount of 1 g/m$^2$ (dry basis) using a bar coater and dried, to form an adhesive layer. Thus, a receptor layer-transfer film was obtained.

| Composition of coating liquid for receptor layer | |
|---|---|
| Vinyl chloride/vinyl acetate copolymer (#1000D, available from Denki Kagaku Kogyo K.K.) | 100 parts |
| Amino modified silicone (X-22-343, available from Shinetsu Kagaku Kogyo K.K.) | 3 parts |
| Epoxy modified silicone (KF-393, available from Shinetsu Kagaku Kogyo K.K.) | 3 parts |
| White pigment (Trade name: A-100, available from IshiharaSangyo K.K.) | 15 parts |
| Methyl ethyl ketone/toluene (1/1 by weight) | 500 parts |
| **Composition of coating liquid for adhesive layer** | |
| Urethane type dry laminating agent (A-130, available from Takeda Chemical Industries, Ltd.) | 100 parts |
| Hardening agent (A-3, available from Takeda Chemical Industries, Ltd.) | 30 parts |

Then, the above receptor layer-transfer film was superposed on a cut coat paper, and they were laminated with each other using a laminator. Thereafter, the substrate film was released, to obtain a thermal transfer image receiving sheet.

Further, an ink for a detection mark having the following composition was prepared. Using the ink, a detection mark having a width of 1 cm and a length of 3 cm was printed at a corner of the receptor layer side surface of the image receiving sheet, to obtain a thermal transfer image receiving sheet (I-1) of the invention.

| Composition of ink for detection mark | |
|---|---|
| Polyester (Bylon 600, available from Toyo Boseki K.K.) | 50 parts |
| Fluorescent brightener (Ubitex OB, available from Ciba Geigy) | 0.5 part |
| Toluene | 400 parts |

(I-2)

The procedure for obtaining the thermal transfer image receiving sheet (I-1) was repeated except for using the following ink as an ink for detection mark, to obtain a thermal transfer image receiving sheet (I-2) of the invention.

| Composition of ink for detection mark | |
|---|---|
| Polyester (Bylon 600, available from Toyo Boseki K.K.) | 50 parts |
| Infrared absorbent (Dial BR-85, available from Mitsubishi Rayon K.K.) | 10 parts |
| Toluene | 400 parts |

(I-3)

The procedure for obtaining the thermal transfer image receiving sheet (I-1) was repeated except for using the following ink as an ink for detection mark, to obtain a thermal transfer image receiving sheet (I-3) of the invention.

| Composition of ink for detection mark | |
|---|---|
| Polyester (Bylon 600, available from Toyo Boseki K.K.) | 50 parts |
| Ultraviolet absorbent (Tinuvin P, available from Ciba Geigy) | 10 parts |
| Toluene | 400 parts |

(I-4)

A detection mark having a width of 1 cm and a length of 3 cm was previously printed at a corner of a surface of the cut coat paper for the thermal transfer image receiving sheet (I-1) using the following ink for a detection mark, and onto all over the surface of the cut coat paper was transferred receptor layer, to obtain a thermal transfer image receiving sheet (I-4) of the invention.

| Composition of ink for detection mark | |
|---|---|
| Polyester (Bylon 600, available from Toyo Boseki K.K.) | 50 parts |
| Magnetic material (MGA3000, available from Dainichi Seika Kogyo K.K.) | 10 parts |
| Toluene | 400 parts |

The same thermal transfer sheet as used in Example A was superposed on the dye receptor layer of each of the thermal transfer image receiving sheets (I-1) to (I-4), and they were subjected to a printing procedure using a thermal head under the conditions of an output of 1 W/dot, a puls width of 0.3 to 0.45 msec. and a dot density of 3 dot/mm to form cyan images. The appearance of each image obtained above was set forth in Table 9

TABLE 9

| Thermal Transfer Image Receiving Sheet | Appearance |
|---|---|
| I-1 | good |
| I-2 | good |
| I-3 | good |
| I-4 | good |

Figure 6:
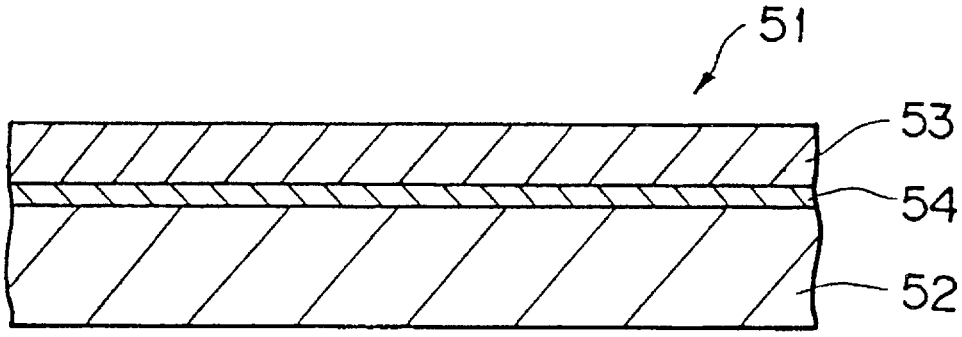
FIG. 6 is a schematic sectional view showing other example of the thermal transfer image receiving sheet according to the invention.

FIG. 6 is a schematic sectional view showing the ninth embodiment of the thermal transfer image receiving sheet according to the invention. In FIG. 6, the thermal transfer image receiving sheet 51 comprises a substrate sheet 52, a transparent dye receptor layer 53 provided on the substrate sheet 52 and a pattern 54 formed between the substrate sheet 52 and the dye receptor layer 53.

As the substrate sheet 52 of the thermal transfer image receiving sheet, any substrate sheets exemplified in the aforementioned embodiments can be employed.

If the adhesion strength between the substrate sheet 52 and the dye receptor layer 53 is poor, those surfaces are preferably subjected to a primer treatment or a corona discharge treatment.

On the substrate 52, a pattern 54 of small letters, marks, symbols or other optional figures is previously printed by a printing method (e.g., offset printing, gravure printing and screen printing) or other method (e.g., thermal transfer method, electrophotographic method, ink jet method, dot print method and handwriting).

The transparent dye receptor layer 53 provided on a surface of the above substrate sheet 52 serves to receive a sublimable dye transferred from a transfer film and to maintain the formed image, without substantially hiding the pattern on the substrate sheet. The resin for forming the dye receptor layer 53 is a transparent resin having sublimable dye-receptive properties, for example, polyester resin, epoxy resin, vinyl chloride resin, vinyl acetate resin, vinyl chloride/vinyl acetate copolymer and styrene resin. The formation of the dye receptor layer 53 can be made by any of a coating method and a receptor layer-transfer method.

Between the substrate sheet 52 and the dye receptor layer 53 may be provided an intermediate layer (cushioning layer), if necessary. By virtue of the intermediate layer, an image almost free from noise in a printing procedure and corresponding to the image information can be transferred and recorded with high reproducibility.

A material for forming the intermediate layer (the cushioning layer) can be appropriately selected from materials exemplified for the intermediate layer in the aforementioned each embodiments.

Further, a slip layer may be provided on the back surface of the substrate sheet 52.

When an image is formed using the thermal transfer image receiving sheet 51 in which the dye receptor layer 53 is made substantially transparent and an optional pattern 54 is formed between the substrate sheet 52 and the dye receptor layer 53, the pattern 54 forms a background of the image. Accordingly, if a false photograph of face is attached to the image receiving sheet, the pattern is hidden within an area where the photograph is attached, and thereby altering or forging becomes apparent. Otherwise, if the image is intended to be removed with special chemicals, the pattern behind the image is simultaneously eliminated, and an accurate recovery of the pattern is difficult.

After an image is formed on the thermal transfer image receiving sheet of this embodiment, on the dye receptor layer may be formed a protective layer composed of a resin having high transparency and high durability such as polyester resin, epoxy resin, acrylic resin and vinyl chloride/vinyl acetate copolymer.

The above embodiment is described below in more concrete with reference to examples. In the examples, "part(s)" and "%" mean "part(s) by weight" and "% by weight", respectively, unless otherwise noted specifically.

EXAMPLE I (J-1)

Onto a front surface of a polyethylene terephthalate film (#25, available from Toray Industries, Inc.) having a heat-resistant slip layer on the back surface was applied a coating liquid for a receptor layer having the following composition in an amount of 5.0 g/m$^2$ (dry basis) using a bar coater, and onto the surface was applied a coating liquid for an adhesive layer having the following composition in an amount of 2.0 g/m$^2$ (dry basis) and dried, to form a receptor layer-transfer film.

| Composition of coating liquid for receptor layer | |
|---|---|
| Vinyl chloride/vinyl acetate copolymer (1000A, available from Denki Kagaku Kogyo K.K.) | 100 parts |
| Epoxy modified silicone (KF-393, available from Shinetsu Kagaku Kogyo K.K.) | 5 parts |
| Amino modified silicone (KS-343, available from Shinetsu Kagaku Kogyo K.K.) | 5 parts |
| Methyl ethyl ketone/toluene (1/1 by weight) | 500 parts |
| **Composition of coating liquid for adhesive layer** | |
| Ethylene/vinyl acetate copolymer resin type heat-sealing agent (AD-37P295, available from Toyo Morton K.K.) | 100 parts |
| Pure water | 100 parts |

Then, onto the same kind of polyester film as used in the above were applied the following inks of yellow, magenta and cyan in each amount of about 3 g/m$^2$ (dry basis) and in each width of 30 mm and dried repeatedly in this order, to form sublimable dye layers of three colors on the film. Thus, a sublimable dye-transfer film was obtained.

| Yellow ink | |
|---|---|
| Dispersed dye (Macrolex Yellow 6G, C.I. Disperse Yellow 201, available from Bayer) | 5.5 parts |
| Polyvinyl butyral resin (Esrec BX-1, available from Sekisui Kagaku Kogyo K.K.) | 4.5 parts |
| Methyl ethyl ketone/toluene (1/1 by weight) | 89.0 parts |

Magenta ink

The same as the above yellow ink except for using a magenta dispersed dye (C.I.Disperse Red 60) as a dye.

Cyan ink

The same as the above yellow ink except for using a cyan dispersed dye (C.I.Solvent Blue 63) as a dye.

Subsequently, onto the same kind of polyester film as used in the above was applied a coating liquid for a protective layer in an amount of 5 g/m$^2$ (solid content) by means of a gravure coating and dried, to form a protective layer on the film. Thus, a protective layer-transfer film was obtained.

| Composition of coating liquid for protective layer | |
|---|---|
| Acrylic resin (BR-83, available from Mitsubishi Rayon K.K.) | 20 parts |
| Polyethylene wax | 1 part |
| Methyl ethyl ketone/toluene (1/1 by weight) | 80 parts |

Then, in a video printer (VY-200, produced by Hitachi, Ltd.) was supplied a Kent paper on which a pattern composed of extremely small sized letters had been previously printed. Using the above-obtained dye receptor layer-transfer film, the dye receptor layer was transferred onto the predetermined position of the pattern-printed surface of the paper, to prepare a thermal transfer image receiving sheet (J-1) of the embodiment. Then, using the above-obtained sublimable dye-transfer film, a full color photograph of face was prepared. This image had high sharpness and high resolution properties, while having the pattern of extremely small sized letters as its background, so that altering or forging of the image was difficult. Further, when other photograph of face was attached onto the image surface, the pattern of that area was hidden, resulting in very unnatural appearance.

Subsequently, using the above-obtained protective layer-transfer film, the protective layer was transferred onto the image surface, the image was prominently enhanced in resistance to fingerprint, resistance to plasticizer, resistance to scratching, etc.

(J-2)

Onto a front surface of a polyethylene terephthalate film (#25, available from Toray Industries, Inc.) having a heat-resistant slip layer on the back surface was applied the above-mentioned coating liquid for a receptor layer in an amount of 5.0 g/m$^2$ (dry basis), in a width of 30 cm and at an interval of 120 cm using a bar coater, and then onto the surface was applied the above-mentioned coating liquid for an adhesive layer in an amount of 2.0 g/m$^2$ (dry basis) and dried, to form a dye receptor layer.

Then, onto the non-coated area of the above polyester film was applied the above-mentioned yellow, magenta and cyan inks in each amount of 3.0 g/m$^2$ (dry basis), in each width of 30 cm and at an interval of 120 cm and dried repeatedly in this order, to form sublimable dye layers of three colors.

Thereafter, onto the non-coated area of the above polyester film was applied an liquid for a protective layer having the above-mentioned composition in an amount of 5.0 g/m$^2$ (dry basis), in a width of 30 cm and at an interval of 120 cm by means of a gravure coating and dried, and further onto the surface was applied the above-mentioned liquid for an adhesive layer in an amount of 1 g/m$^2$ (dry basis) and dried, to form a protective layer. Thus, a composite transfer film consisting of a dye receptor layer, a dye layer and a protective layer, sequentially disposed on the polyester film in this order was prepared.

Using the above composite transfer film, first, a dye receptor layer of the film was transferred onto a substrate sheet (i.e., ABS resin sheet for card), to prepare a thermal transfer image receiving sheet (J-2) of the embodiment and then to form an image thereon using the same video printer. As a result, the same excellent effects as those of the above-mentioned thermal transfer image receiving sheet (J-1) can be obtained.

The present invention may be practiced in other various embodiments, without deviating from the spirit or major feature thereof. Accordingly, the examples as described above are simple "examples" in every respect, and the present invention should not be interpreted in a restricted manner. The scope of the present invention is defined by Claims and is not confined by the body of the specification at all. In addition, all of the modifications or changes within an equivalent range for claims fall into the scope of the present invention.

What is claimed is:

1. A thermal transfer image receiving sheet comprising:

a substrate sheet;

a bubble-containing layer provided on at least one side surface of the substrate sheet containing bubbles formed by foaming microcapsules and an adhesive;

an intermediate layer coated on a surface of the bubble-containing layer; and a dye receptor layer provided on a surface of the intermediate layer.

2. A thermal transfer image receiving sheet according to claim 1, wherein said microcapsules are prepared by encapsulating butane or pentane with polyvinylidene chloride or polyacrylonitrile.

3. The thermal transfer image receiving sheet as claimed in claim 1, wherein the intermediate layer is formed from at least any one of an acrylic resin, a cellulose resin, a polyester resin, a polyurethane resin, a polycarbonate resin and a partially crosslinked resin thereof.

4. The thermal transfer image receiving sheet as claimed in claim 1 wherein the intermediate layer contains a filler.

5. The thermal transfer image receiving sheet as claimed in claim 4 wherein the content of the filler is in the range of 10 to 600 wt. % based on the weight of the resin component contained the intermediate layer.

6. The thermal transfer image receiving sheet as claimed in claim 1 wherein the bubble-containing layer is composed of an adhesive.

7. There thermal transfer image receiving sheet as claimed in claim 1 wherein the substrate sheet is a pulp paper.

8. The thermal transfer image receiving sheet as claimed in claim 1 wherein the bubble-containing layer and/or the intermediated layer contains at least one additive selected from a white pigment, a fluorescent brightener, an antistatic agent, an extender pigment and a filler.

* * * * *